United States Patent [19]

Okada et al.

[11] Patent Number: 4,735,323

[45] Date of Patent: Apr. 5, 1988

[54] OUTER APPEARANCE QUALITY INSPECTION SYSTEM

[75] Inventors: Takao Okada, Kawasaki; Hiromu Uda, Momoyama; Hiromu Maeda; Eiichi Suzuki, both of Hamamatsu, all of Japan

[73] Assignee: 501 Ikegami Tsushinki Co., Ltd., Tokyo, Japan

[21] Appl. No.: 790,874

[22] Filed: Oct. 24, 1985

Related U.S. Application Data

[63] Continuation-in-part of Ser. No. 550,038, Nov. 8, 1983, abandoned.

[30] Foreign Application Priority Data

Nov. 9, 1982 [JP] Japan ..... 57-196646

[51] Int. Cl.[4] ..... B07C 5/342

[52] U.S. Cl. ..... 209/582; 209/555; 209/586; 209/587; 209/539; 356/237; 356/407; 356/425; 358/106; 382/18

[58] Field of Search ..... 209/555, 546, 551, 576, 209/577, 580, 581, 582, 585, 586, 587, 939, 558, 539; 356/425, 407, 237, 394, 398, 384–387; 382/17, 18; 358/106, 107; 364/526; 1/38

[56] References Cited

U.S. PATENT DOCUMENTS

| | | | |
|---|---|---|---|
| 3,480,141 | 11/1969 | Rock | 209/586 |
| 3,851,156 | 11/1974 | Green | 364/526 |
| 4,205,752 | 6/1980 | Malvick et al. | 209/582 |
| 4,246,098 | 1/1981 | Conway et al. | 209/582 |
| 4,308,959 | 1/1982 | Hoover et al. | 209/587 |
| 4,327,375 | 4/1982 | Leclerc | 356/237 |
| 4,376,951 | 3/1983 | Miyazawa | 209/939 |
| 4,378,495 | 3/1983 | Miller | 358/106 |
| 4,493,420 | 1/1985 | Dennis | 358/106 |
| 4,513,316 | 4/1985 | Kobayashi et al. | 358/107 |

FOREIGN PATENT DOCUMENTS

| | | | |
|---|---|---|---|
| 57196646 | 5/1984 | Japan . | |
| 1589723 | 5/1981 | United Kingdom | 356/384 |

*Primary Examiner*—Robert B. Reeves
*Assistant Examiner*—Donald T. Hajec
*Attorney, Agent, or Firm*—Kenyon & Kenyon

[57] ABSTRACT

An outer appearance quality inspection system comprising a mechanism for aligning objects to be inspected, a mechanism for transporting the aligned objects, light projectors for illuminating a light within a predetermined wavelength range against the objects being transported, light receiving devices for receiving the light reflected from each of the objects so as to convert the light into an electrical signal, an electronic circuit for obtaining the data representative of the conditions of the surfaces of the object in response to the electrical signal derived from the light receiving devices, and a mechanism for sorting the objects being transported in response to the data derived from the electronic circuit. The system can inspect the size, visible surface damages and coloring of an object such as orange automatically and reliably.

38 Claims, 33 Drawing Sheets

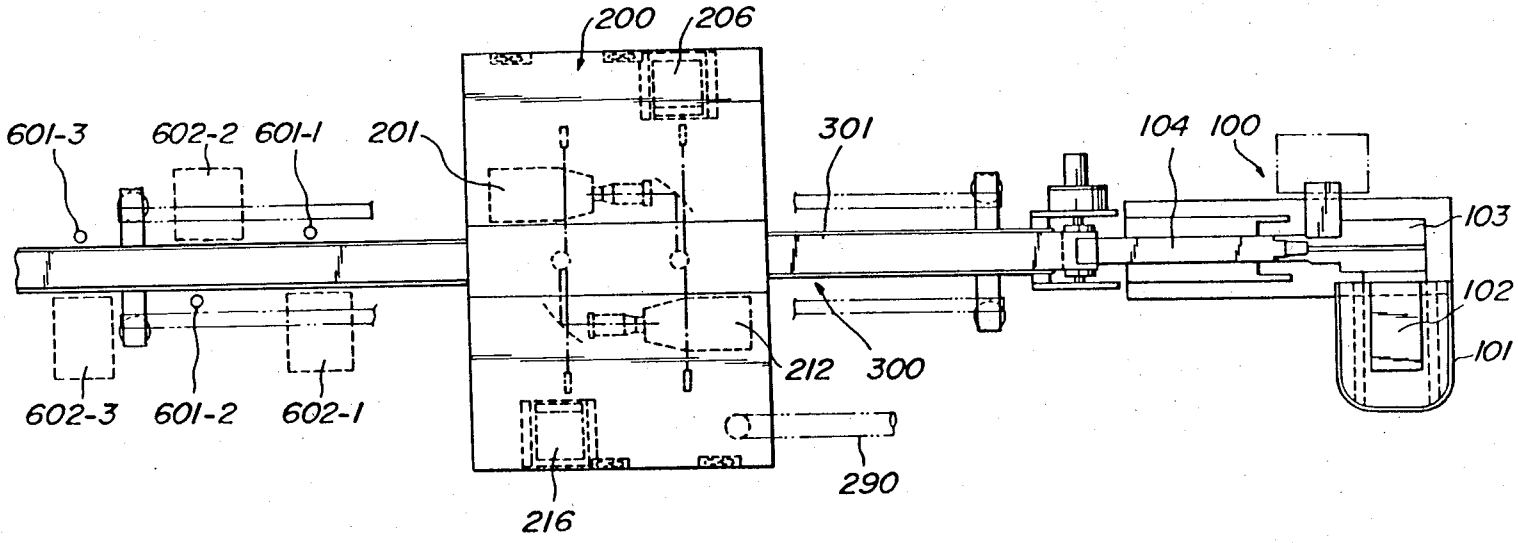
FIG_2.1

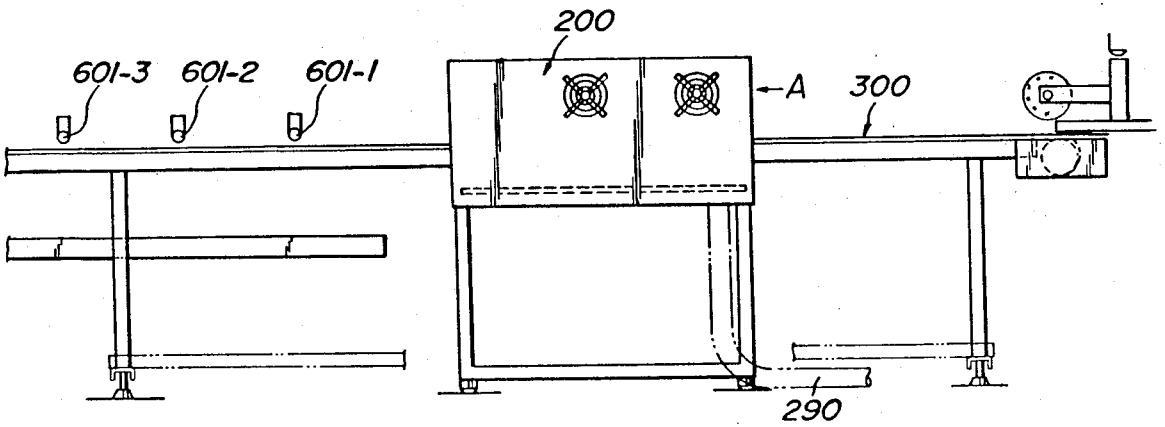
FIG. 2.2

FIG_2_3
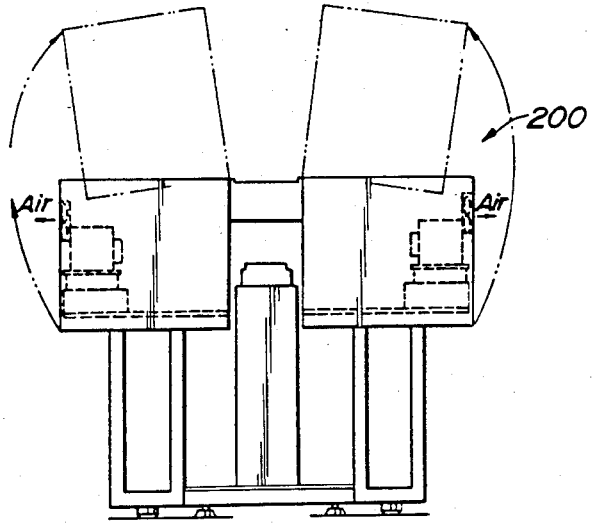

FIG_3_1
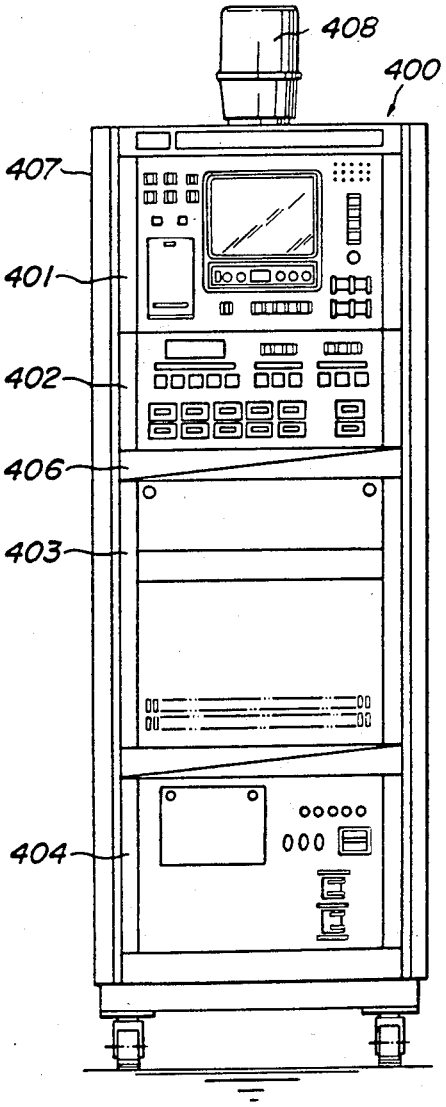
FIG_3_2
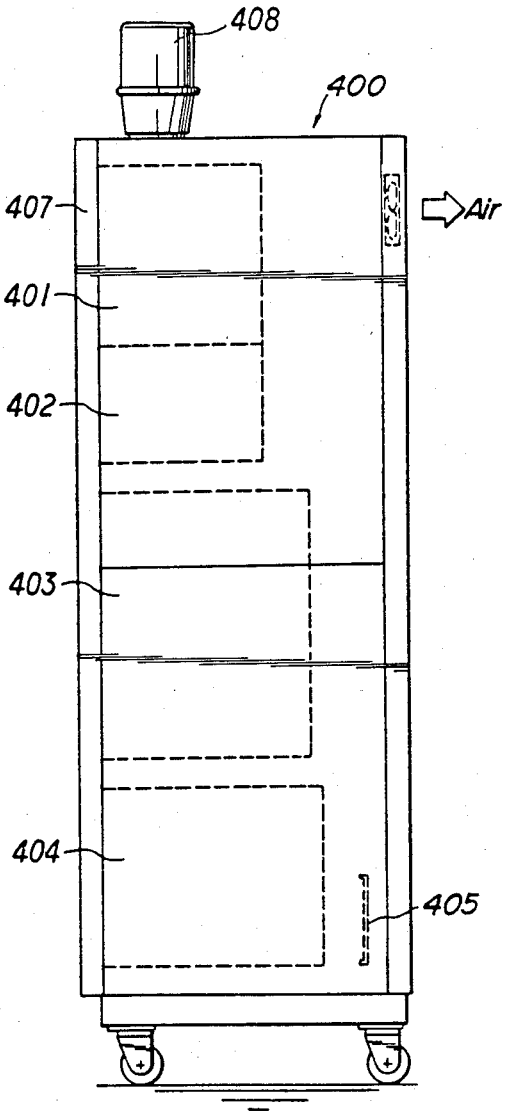

FIG. 5.1
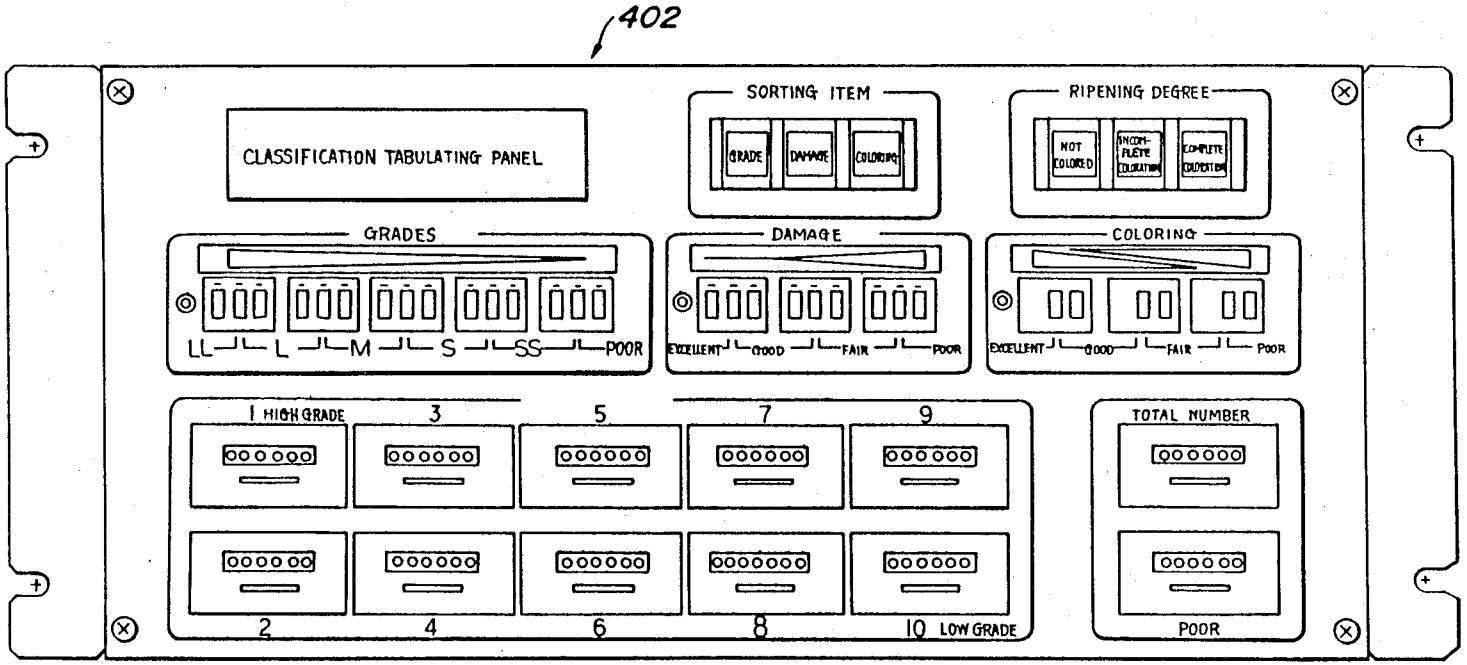

FIG_5_2
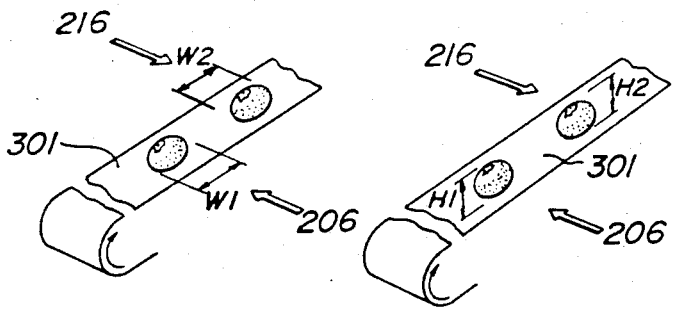
FIG_5_3
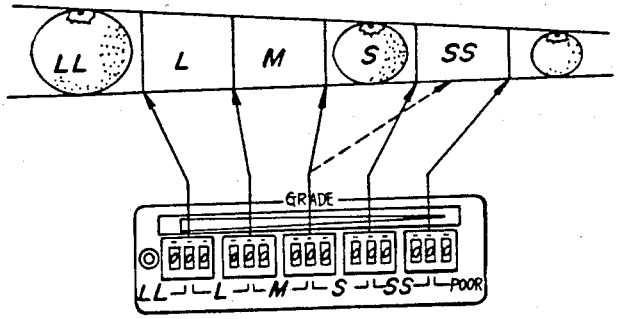

FIG_5_4
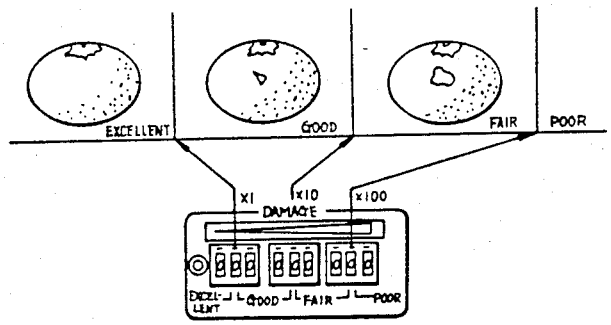
FIG_5_5
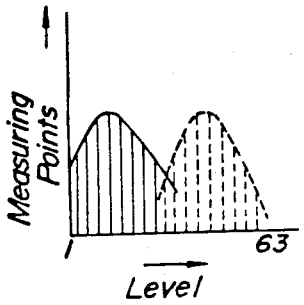

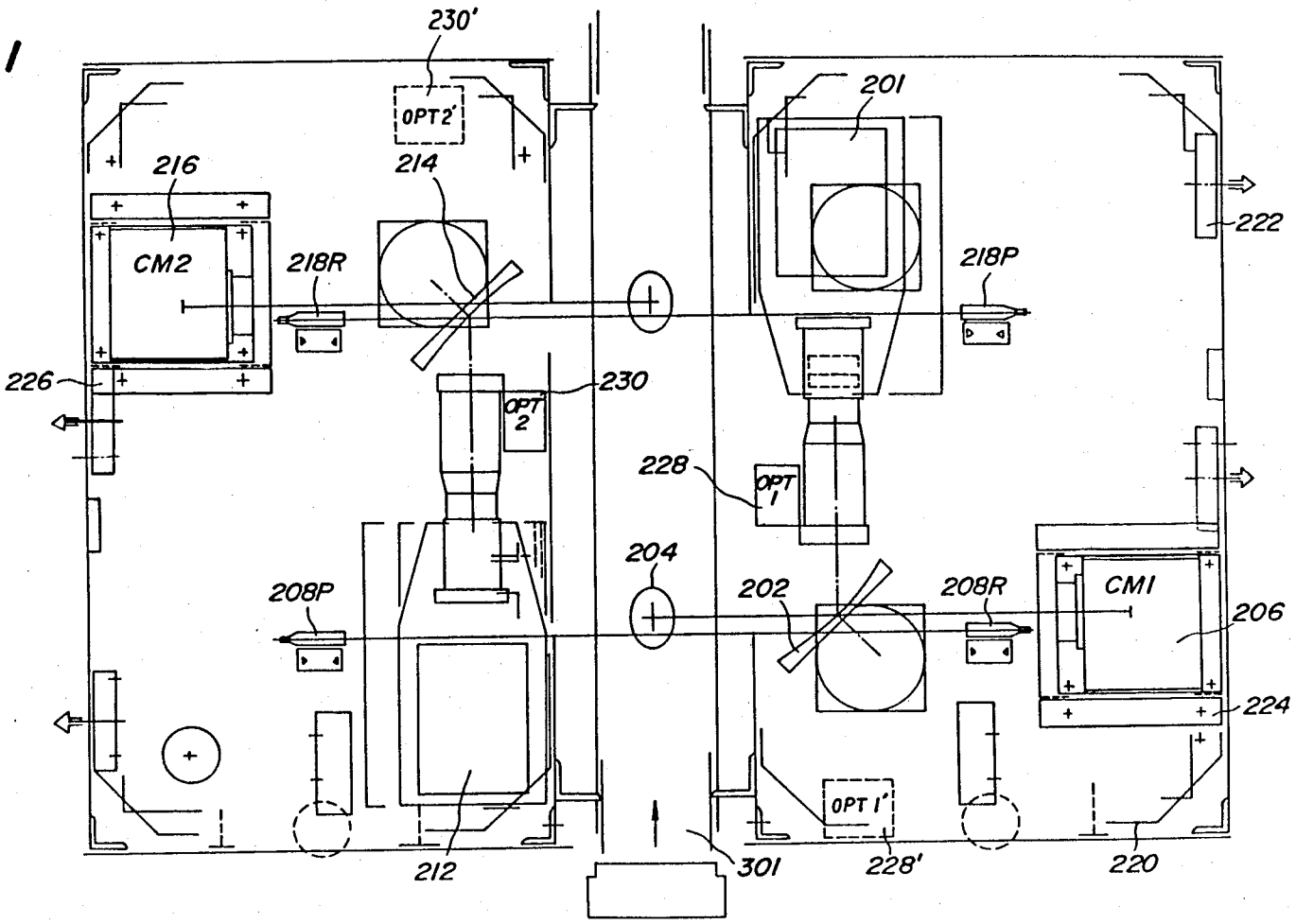
FIG. 7.1

FIG_7_2
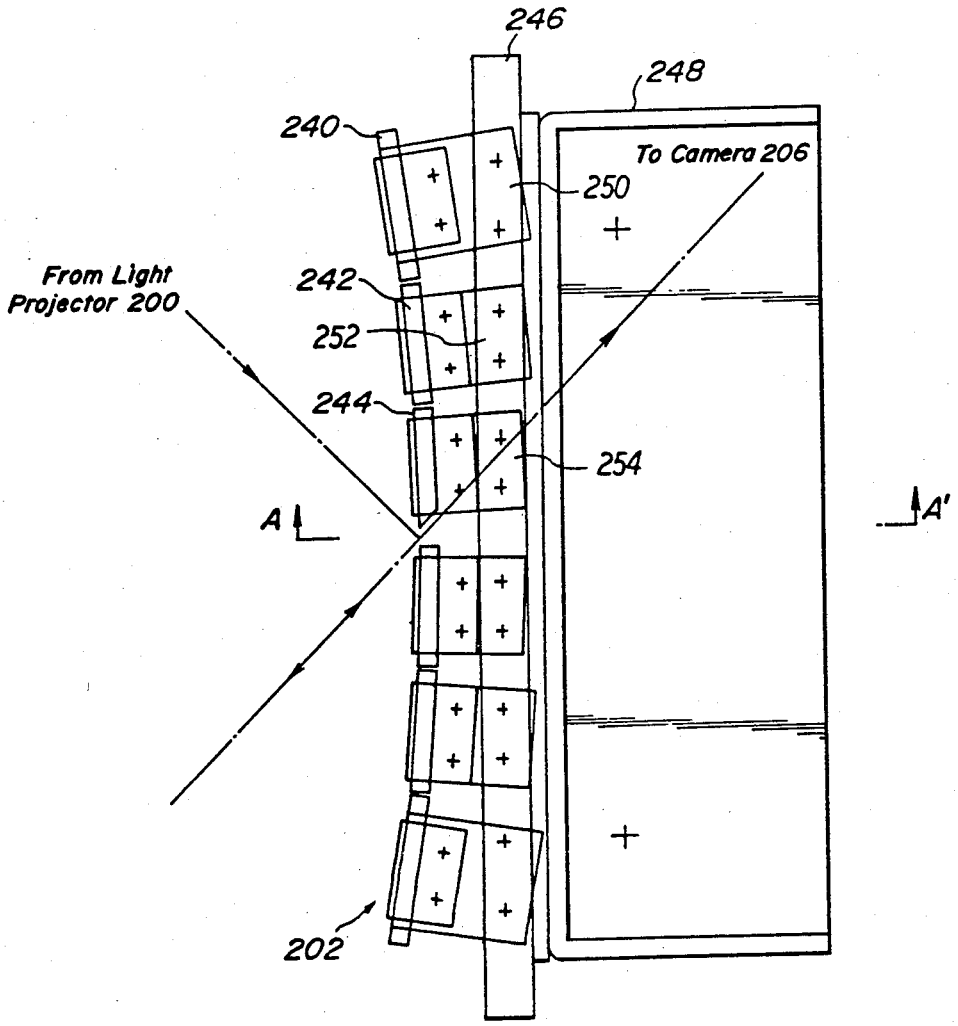

FIG_8_1
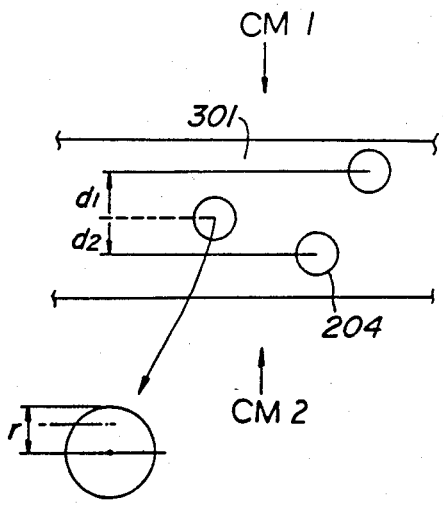
FIG_8_2
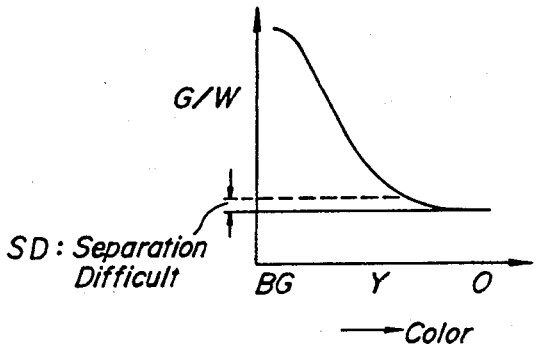

FIG_8_3
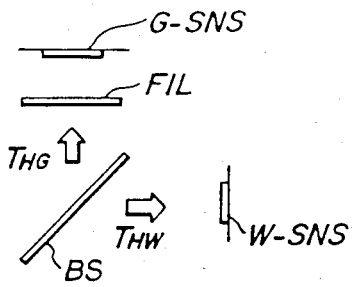
FIG_8_4
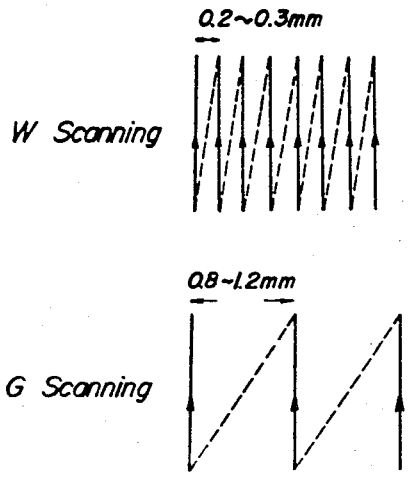

FIG. 9.1A
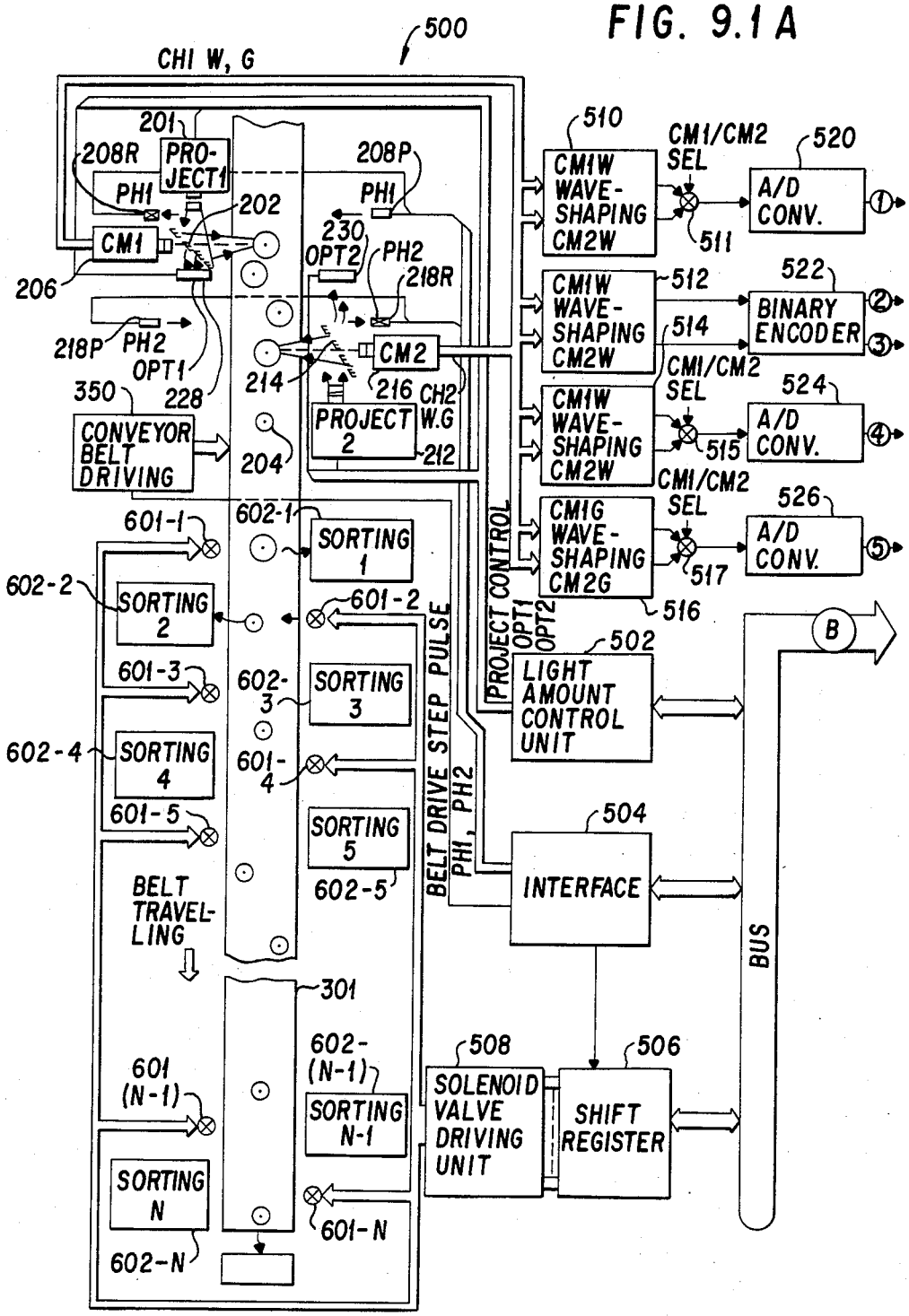

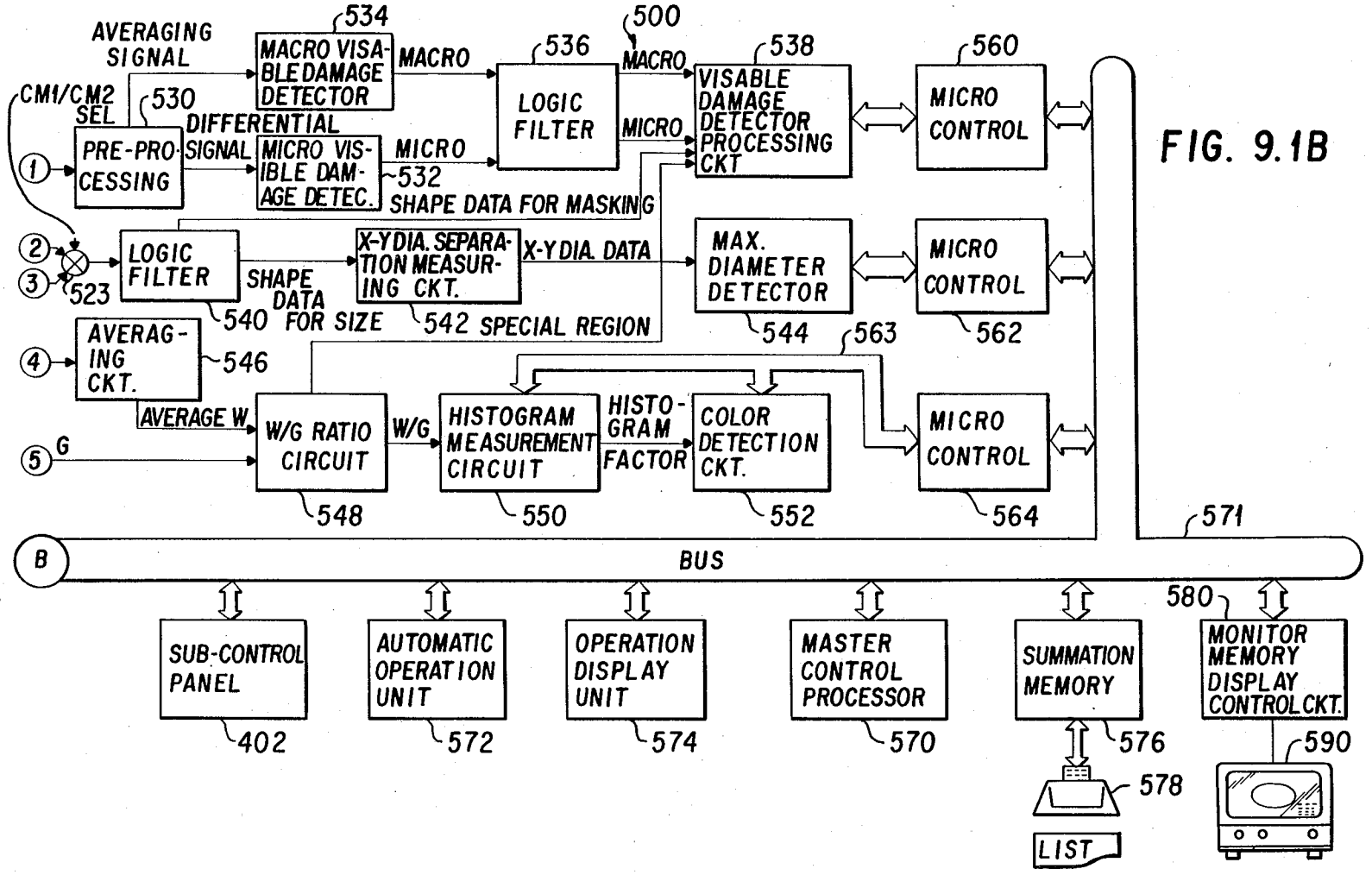
FIG. 9.1B

FIG_9_2A
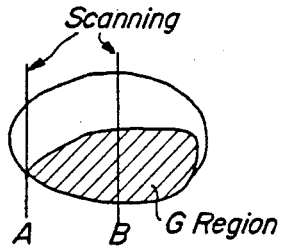
FIG_9_2B
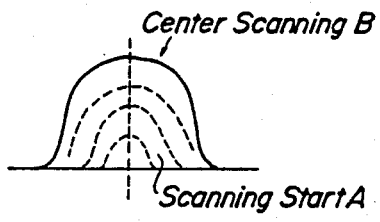
FIG_9_3
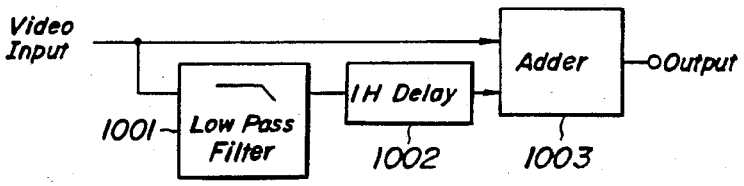

FIG_9_4A
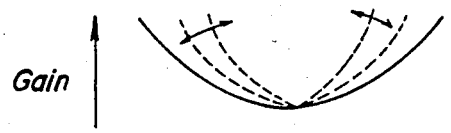
FIG_9_4B
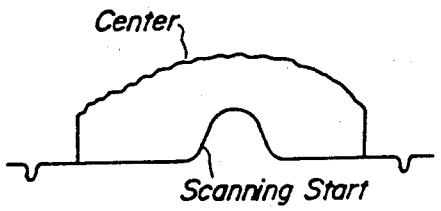

FIG_9_5A
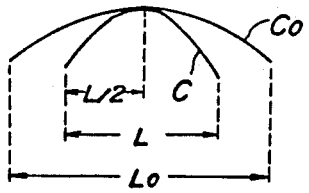
FIG_9_5B
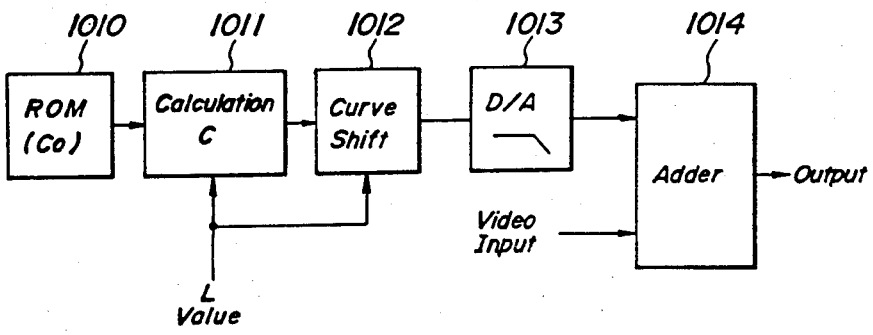

FIG_9_6A
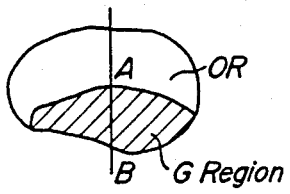
FIG_9_6B
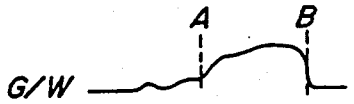
FIG_9_6C
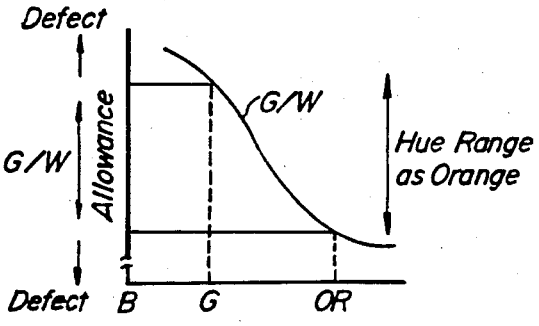

FIG_9_7A
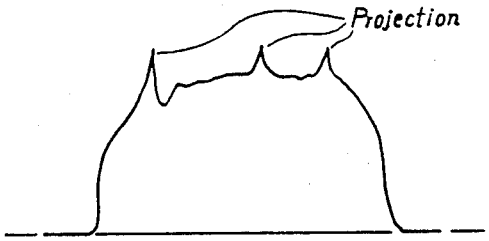
FIG_9_7B
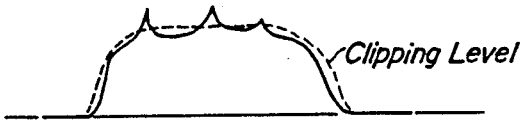
FIG_9_7C
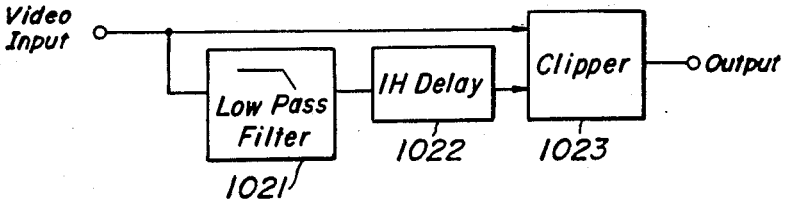

FIG_11_1
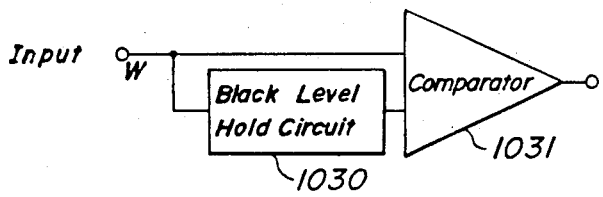
FIG_11_2A
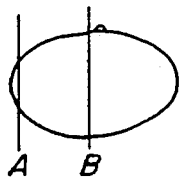
FIG_11_2B
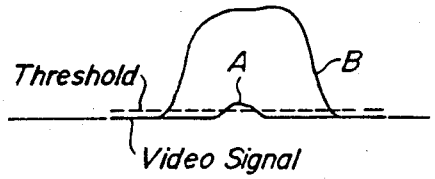

FIG_12
Smoothing
| | | |
|---|---|---|
| 1 | 1 | 1 |
| 1 | 8 | 1 |
| 1 | 1 | 1 |
Or
| | | |
|---|---|---|
| -1 | -1 | -1 |
| -1 | 9 | -1 |
| -1 | -1 | -1 |
Or
Emphasizing
| | | |
|---|---|---|
| | 1 | |
| 1 | 4 | 1 |
| | 1 | |
| | | |
|---|---|---|
| | -1 | |
| -1 | -5 | -1 |
| | -1 | |
FIG_14A W Scanning
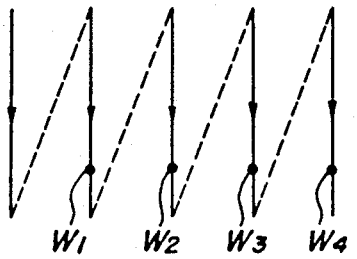
FIG_14B G Scanning
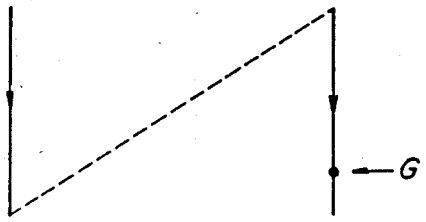

| | | |
|---|---|---|
| A | B | C |
| D | E | F |
| G | H | I |

| | | |
|---|---|---|
| -1 | -1 | -1 |
| -1 | 9 | -1 |
| -1 | -1 | -1 |

| | | |
|---|---|---|
| 1 | 1 | 1 |
| 1 | 8 | 1 |
| 1 | 1 | 1 |

| | | |
|---|---|---|
| | -1 | |
| -1 | +5 | -1 |
| | -1 | |

| | | |
|---|---|---|
| | 1 | |
| 1 | 4 | 1 |
| | 1 | |

FIG. 12-7A
FIG. 12-7B
FIG. 12-7C
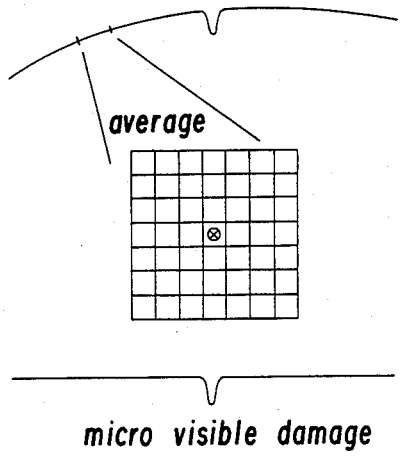
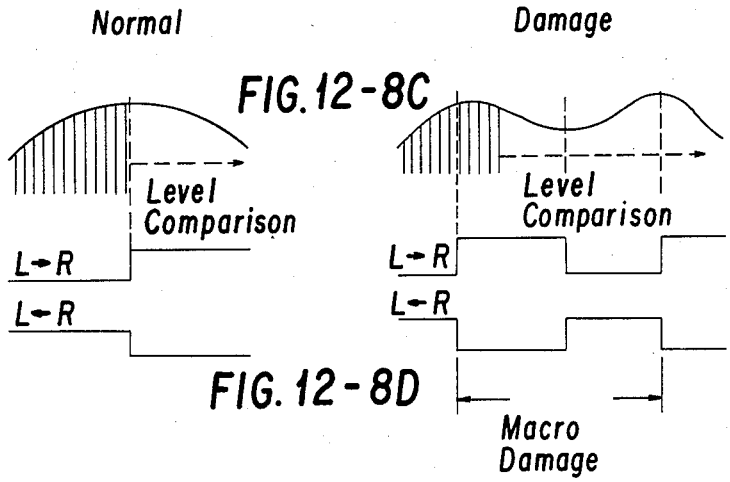

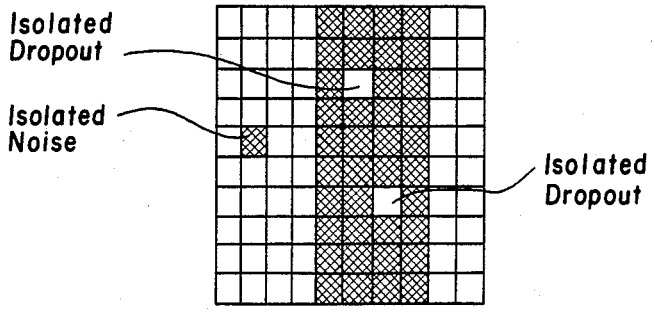
FIG. 12-9
FIG. 12-10A
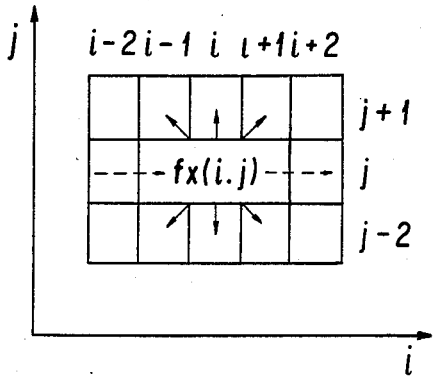
FIG. 12-10B
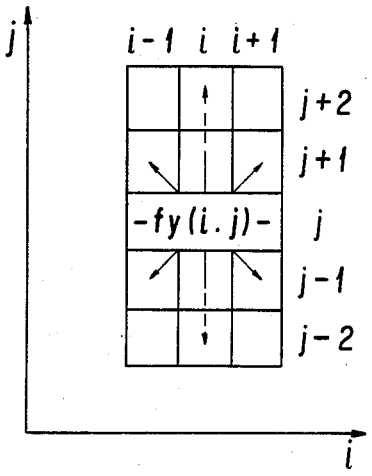

FIG. 16.1
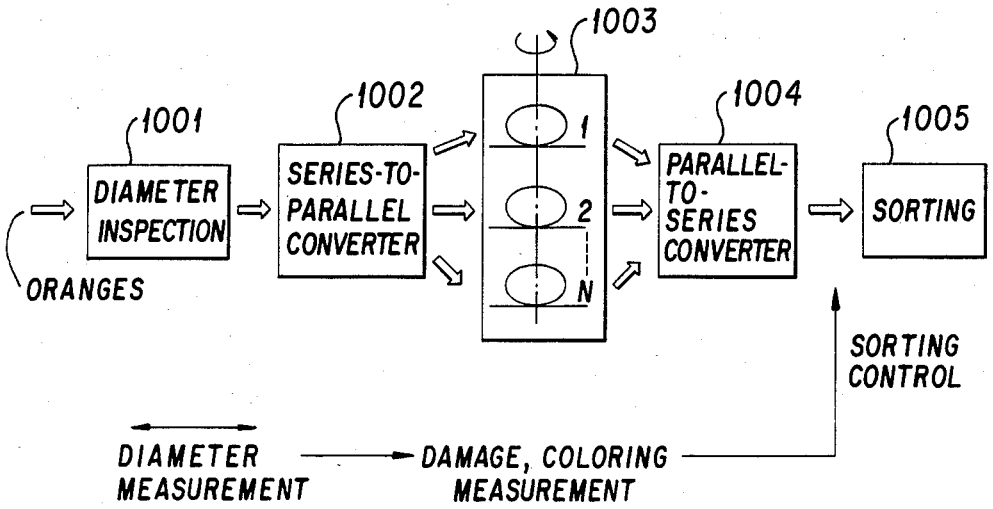
FIG. 16.2
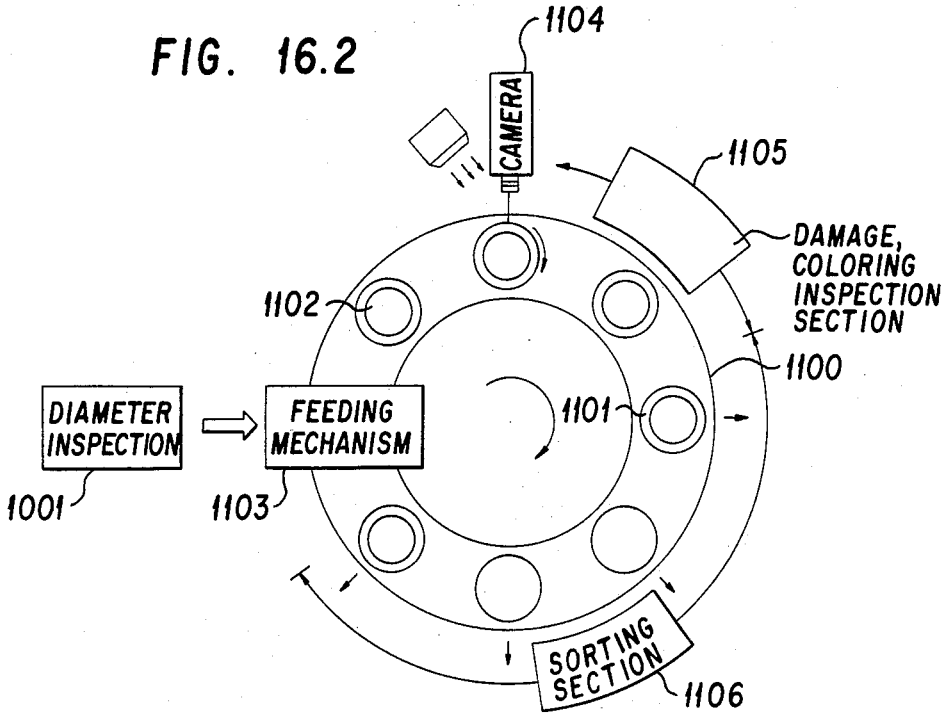

FUNCTION
1726
CDO
1724
1725
CDS
1782
REGIS-TER
1780
PULSE GENER-ATOR
1772
1778
COMPAR-ATOR
REGIS-TER
HQ REG
1721
1746
FF
1748
SELECTOR
1708
SO10 SEL
MDO SEL
1709
1743
1747
1750
LATCH
1751
ARITHMETIC UNIT
1744
1745
1768
REGISTER
1766
REGISTER
1718
HQ REG
1723
MDR
1706
HMW
HMR
1707
FF
1740
1734
HIST MEMORY
1742
1774
REGISTER
1776
1722
HQ RES
1719
SO20
HQO
FF
1770
1711
1784
HCI
HCM
1710
1756
1762
1720
1717
TRANSPORT ADDRESS
1736
FF
1702
HCS SEL
HCC SEL
1703
1701
HCS
1732
SELECTOR
1738
COUNTER
1704
HCC SEL
HCC RES
1705
1784
ADDER
1786
COUNTER
1752
1712
CM1 SEL
COUNTER
1758
1754
1713
CM2 SEL
SELECTOR
1760
FF
1715
SO1MSEL
SO1MRES SEL
1714
SO1MEMORY
1764
SO1 W
1716

OUTER APPEARANCE QUALITY INSPECTION SYSTEM

This application is a continuation-in-part of U.S. Ser. No. 550,038, filed Nov. 8, 1983, now abandoned.

BACKGROUND OF THE INVENTION

1. Field of the Invention

The present invention relates to an outer appearance quality inspection system for electronically and optically detecting and judging the outer appearance and grades such as size, stain or visible damages and color of objects such as fruits and sorting them according to their sizes and grades. The outer appearance quality inspection system in accordance with the present invention is preferably adaptable for use in automatic sorting of oranges.

2. Description of the Prior Art

So far sieves or screens have been commonly used in order to classify oranges according to their sizes. When such sieve or screen classification system is employed, the oranges must be conveyed for a long distance. As a result, the oranges collide with each other and with other members of the system and are caused to rotate many times. In addition, they fall through the sieve for a long distance. As a consequence, they are likely to be damaged.

In order to classify the oranges according to their color and visible damages, people in charge of such classification must handle each orange, but the classification standards are different among those people. That is, their classification standards are varied. Furthermore, such manual classification is cumbersome and not efficient.

There has been devised an automated orange sorting system with photoelectronic conversion devices, but its use is limited only to one function such as the detection of size, color or visible damage of oranges. Furthermore, the automatic orange sorting system is very complicated in construction. Moreover, the classification results are not satisfactory, because the system cannot perform exact sorting of the oranges according to their size, color or visible damages. Thus, the automatic orange sorting system is not satisfactory in practice.

In the case of classification of oranges according to their sizes, the classification results vary depending upon whether an orange is disposed along the center line of a conveyor belt or offset from the center line. In the automatic orange sorting system, the offset of an orange from the center line of the conveyor is measured in order to obtain a true size of an orange. The size of an orange is defined as the maximum diameter of the equator of the orange which divides the orange into two equal parts, i.e., top and bottom parts.

In the prior art automatic orange sorting system, optoelectronic switches are used to measure the size of oranges. Only one pair of optoelectronic switches may sufficiently be used if an orange is transported by a conveyor belt with its top or bottom portion directed upwardly, but when an orange is transported by a conveyor in such a way that its equator is positioned vertically, a large number of optoelectronic switches must be disposed vertically. The accuracy of measurement of the size of an orange is dependent upon the distance between the vertically spaced optoelectronic switches, so that it is difficult to accurately measure the size of an orange. Furthermore, the automatic orange sorting system is complicated in construction.

In order to detect the color of an orange, the green light (G) and the red light (R) which are very sensitive to the color change of the orange and the infrared ray (IR) which is not so sensitive to the color change of the orange are directed to the same spot on the surface of the orange. The reflected light rays from the spot are sensed in order to compute ratios IR/R and IR/G between the levels G, R and IR of the reflected green and red light rays and infrared ray. The color of the orange is detected from such ratios. However, such system as described above has a complicated arrangement and there has not been available yet a means for displaying the computed ratios in a suitable manner for inspection.

The classification of oranges in accordance with their visible damages has been difficult and has the following problems. First, when an orange which is being transported by a conveyor belt is viewed from its one side, the peripheral portion of the orange is viewed to be dark because the oranges are in general in the form of sphere. As a result, the dark portion is erroneously detected as a visible damage. Secondly, a TV camera output in response to the light reflected from the green portion of an orange is low, so that it is difficult to detect visible damages on the green portion. Thirdly, the TV camera output in response to visible white or silver white damages is almost the same as the output in response to the light reflected from other portions of an orange. Fourthly, the portions such as small projections like bubbles of white-yellow color which have a high reflectivity are erroneously detected as visible damages. Fifthly, since oranges are in general in the form of a sphere, there always exists a point at which the angle of incidence and the angle of reflection are equal to each other. Therefore, it follows that if a visible damage exists at such a point, it cannot be detected.

SUMMARY OF THE INVENTION

A first object of the present invention is to provide an outer appearance quality inspection system which ensures precise judgement of the size, color and visible damages of objects.

A second object of the present invention is to provide an outer appearance quality inspection system in which the operations of judging objects according to their size, color and visible damages are simplified and the judgement results are displayed so as to aid the utilization for further purposes.

A third object of the present invention is to provide an outer appearance quality inspection system in which it is ensured that objects are classified efficiently on the basis of the judgement results.

A fourth object of the present invention is to provide an outer appearance quality inspection system of the type described above which is very simple in construction and yet highly reliable and dependable in operation.

In order to achieve these objects, an outer appearance quality inspection system according to the present invention comprises first means for aligning objects to be inspected, second means for transporting the aligned objects, third means for illuminating a light within a predetermined wavelength range against the objects being transported, fourth means for receiving the light reflected from each of the objects so as to convert the light into an electrical signal, fifth means for obtaining the data representative of the conditions of the surfaces of the object in response to the electrical signal derived from the fourth means, and sixth means for sorting the objects being transported by the second means in response to the data derived from the fifth means.

It is preferable that the fifth means produces data representative of the size, visible damage and coloring of each of the objects so as to sort the objects.

It is also preferable that the fifth means has means for comparing the data representative of the size, visible damage and coloring with references for the size, visible damage and coloring of the objects which are variably determined.

Preferably, the fifth means has means for computing data representative of the distributions of visible damages and coloring of each of the objects, and the system further comprising seventh means for displaying the distributions based upon the data derived from the fifth means.

Preferably the fifth means produces combination data of the sizes, visible damage and coloring of the objects, and the sixth means sorts the objects in response to the combinations data of the sizes, visible damage and coloring.

It is preferable that the sixth means has memory means for memorizing the number of objects which are sorted according to the grades of the objects which are determined by the combination data.

It is also preferable that the first, second, third, fourth, fifth and sixth means are operated in synchronism with each other.

Here, the first, second, third, fourth, fifth, sixth and seventh means may preferably be operated in synchronism with each other.

It is preferable that the fifth means has means for measuring a horizontal diameter and a vertical diameter of the object, means for comparing the horizontal diameter with vertical diameter and means for defining the greater diameter as the maximum diameter of the object.

It is also preferable that the fifth means has means for detecting micro visible damage, means for detecting macro visible damage, means for judging a visible damage from the detected micro and macro visible damages.

Here, the electrical signal may be smoothed to form an average signal which is applied to the means for detecting macro visible damage and an outer profile of the object may be emphasized to form a difference signal which is applied to the means for detecting micro visible damage.

It is also preferable that the fifth means has means for forming an average visible light region signal from the electrical signal, means for forming a green region signal from the electrical signal, means for obtaining a level ratio of the average visible light region signal to the green region signal, means for obtaining a histogram of the ratio and means for judging coloring of the object from the histogram.

The average visible light region signal may be compared with the green region signal.

The histogram obtaining means may judge that the color of the object is represented by a point in the histogram at which the histogram is equally divided.

The above and other objects, effects and features of the present invention will become more apparent from the following description of preferred embodiments thereof taken in conjunction with the accompanying drawings.

BRIEF DESCRIPTION OF THE DRAWINGS

FIG. 2-1 is a top view thereof;

FIG. 2-2 is a side view thereof;

FIG. 2-3 is an elevation view seen from line A of FIG. 2-2;

FIG. 3-1 is a front view showing an embodiment of an optically reading device in the orange sorting system shown in FIG. 1;

FIG. 3-2 is a side view thereof;

FIG. 5-1 is a front view showing, on enlarged scale, an embodiment of a sub-control panel of the processing device as shown in FIG. 1;

FIGS. 5-2, 5-3, 5-4 and 5-5 are views used to explain the classification of oranges according to the present invention;

FIG. 7-1 is a top view thereof;

FIGS. 7-2 and 7-3 are detailed views showing, on enlarged scale, a mirror 202 as shown in FIG. 6;

FIG. 8-1 is a view used to explain the depth of focus;

FIG. 8-2 is a view used to explain a color separation filter;

FIGS. 8-3 and 8-4 are views used to explain the compensation of the sensitivity to the green light in a CCD image sensor;

FIGS. 9-1A and 9-1B are block diagrams showing an embodiment of an optical system, a conveyor system and an image processing-control circuit in the orange sorting system shown in FIG. 1;

FIG. 9-2A is a view used to explain the scanning of an orange by an optical system;

FIG. 9-2B illustrates an output waveform obtained by the scanning of an orange;

FIG. 9-3 is a block diagram showing an embodiment of a signal waveform compensation circuit;

FIG. 9-4A illustrates an average compensation curve;

FIG. 9-4B illustrates an output waveform therefrom;

FIG. 9-5A is a view used to explain the correction by means of the average correction curve;

FIG. 9-5B is a block diagram showing an embodiment of a correction circuit;

FIGS. 9-6A, 6B and 6C are views used to explain the color correction of a video signal;

FIGS. 9-7A, 7B and 7C are views used to explain how the signals representative of small projections on the surface of an orange can be eliminated;

FIG. 11-1 is a block diagram showing an embodiment of a binary encoder;

FIGS. 11-2A and 11-2B are views used to explain how the data of the profile of an orange are derived;

FIG. 12-1 is an explanatory diagram of outline-emphasis;

FIGS. 12-2A and 12-2B are explanatory diagrams of smoothening process;

FIG. 12-3 is a diagram illustrating picture cells;

FIGS. 12-4A and 12-4B are diagrams illustrating outline-emphasized picture cell information;

FIGS. 12-5A and 12-5B are diagrams illustrating smoothened picture cell information;

FIG. 12-6 is a block diagram showing one embodiment of the smoothening and outline-emphasizing circuits;

FIG. 12-7 is an explanatory diagram of micro damage detection;

FIG. 12-8 is an explanatory diagram of macro damage detection;

FIG. 12-9 is a diagram illustrating isolated dropout and noise;

FIGS. 12-10A and 12-10B are explanatory diagrams of the detection of stain or larger dropout;

FIG. 14A illustrates the scanning of the signal W;

FIG. 14B illustrates the scanning of the signal G;

FIG. 16-1 is a diagram showing another embodiment of the present invention in which a plurality of oranges are inspected at the same time;

FIG. 16-2 is a diagram showing further embodiment for inspecting an outer appearance quality of an orange while the orange is being rotated, according to the present invention.

DETAILED DESCRIPTION OF THE PREFERRED EMBODIMENTS

Figure 1:
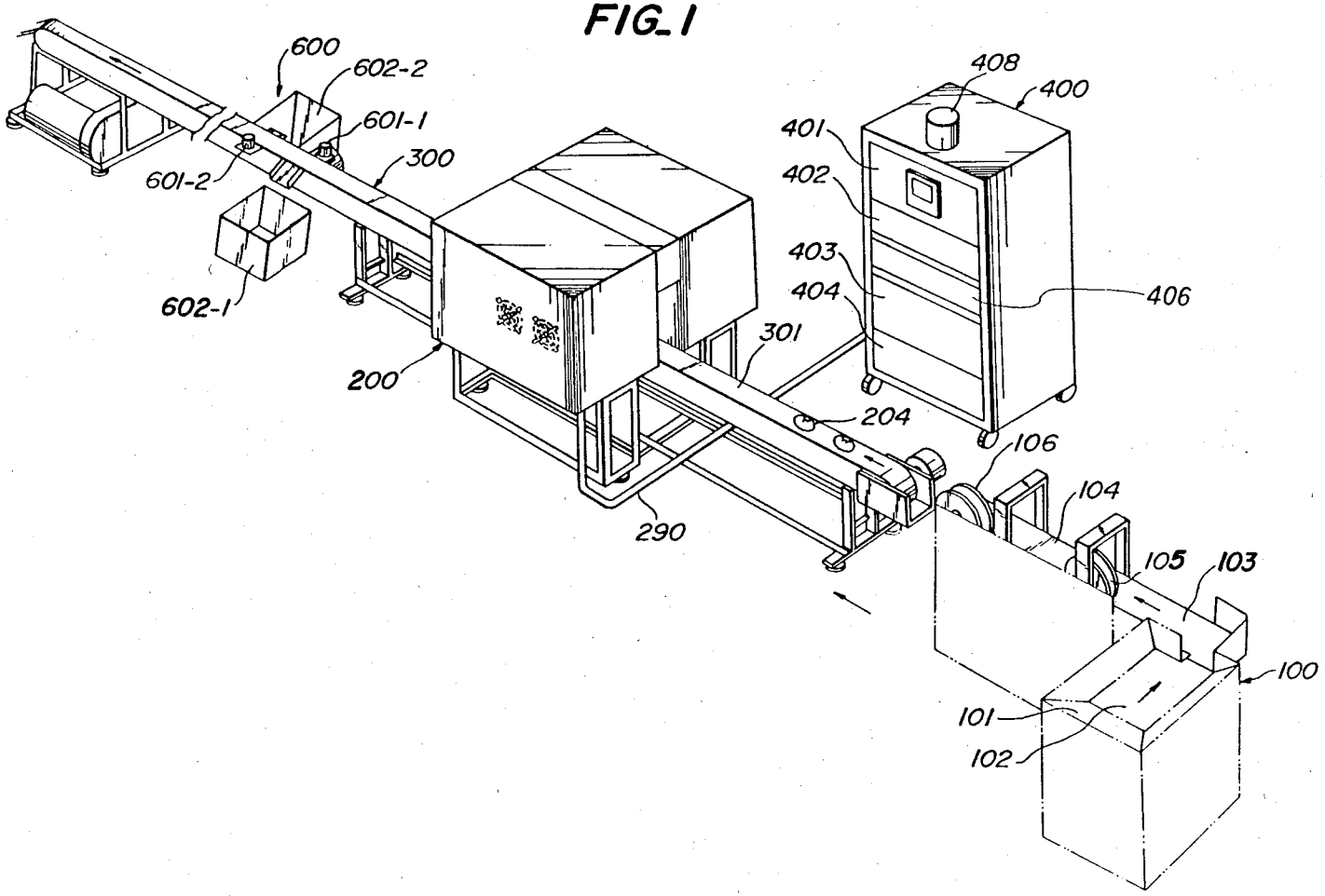
FIG. 1 is a perspective view showing an orange sorting system which is a preferred embodiment of the present invention.

Same reference numerals are used to designate similar parts throughout the figures hereinafter.

FIGS. 1, 2-1 and 2-2 show a preferred embodiment; that is, an orange sorting system, in accordance with the present invention. According to the present embodiment, the diameter, visible damage and color of each orange are evaluated and the oranges are sorted depending upon their evaluation results.

In FIGS. 1, 2-1 and 2-2, reference numeral 100 designates an orange feeding device; 200, an optical analyzing device for optically analyzing the outer appearance of oranges supplied from the orange feeding device 100; 300 an orange transporting system for transporting the oranges through the optically analyzing device 200; 400, a processing device for detecting the diameter, visible damage and color of each orange in response to the output from the optical analyzing device 200; and 600, an orange sorting device for sorting the oranges transported by the orange transporting system 300 in response to the output from the processing device 400.

The orange feeding device 100 has an orange charging inlet 101 and an orange transport belt 102 which transports the oranges in the direction indicated by the arrow. An orange transport belt 103 which transports the oranges in the direction indicated by the arrow is provided with many projections extended over the top surface thereof. The transport belt 103 is driven in such a way it is vibrated. As a result, the oranges which are charged through the inlet 101 and transported by the belt 102 are aligned in one line while it is transported by the belt 103. An orange transport belt 104 which is V-shaped in cros section is wrapped around the horizontally-spaced pulleys 105 and 106 each of which has a V-shaped groove lined with fur brush. Therefore, the oranges which have been transported by the belt 103 is further transported by the belt 104 toward the orange transportation device 300. While the oranges are being transported by the V belt 104, the surfaces of the oranges are cleaned by the pulleys 105 and 106 and the oranges are aligned in such a way that the equator of each orange is in parallel with the V belt 104. Furthermore, the oranges which have been transported by the belt 103 to the V belt 104 are aligned in one line by the pulleys 105 and 106.

The orange transporting system 300 has an endless conveyor belt 301 onto which the oranges transported in one line by the V belt 104 are dropped one by one. The speed of the conveyor belt 301 is faster than that of the V belt 104 so that the oranges which have been dropped on the conveyor belt 301 are spaced apart from each other by a predetermined distance.

Figure 6:
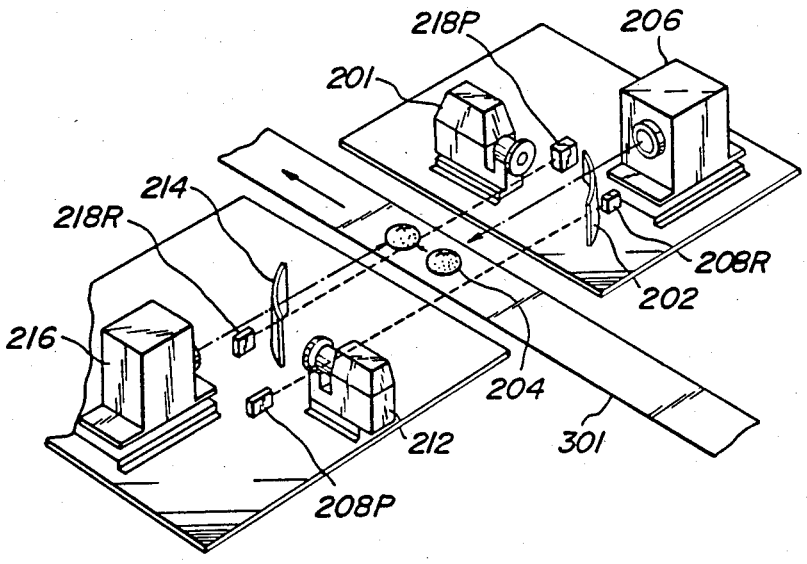
FIG. 6 is a perspective view showing an embodiment of an optical system to be used in the orange sorting system shown in FIG. 1.

The optically analyzing device 200 optically reads the picture or image information of the oranges which are transported by the conveyor belt 301 in one line and are spaced apart from each other by a predetermined distance. The optically analyzing device 200 has two cameras 206 and 216 disposed on the opposite sides of the conveyor belt 301 and are offset with respect to each other as shown in FIG. 2-1 or FIG. 6. The video information obtained by the cameras 206 and 216 are transmitted through a cable 290 (See FIG. 1) to the processing device 400.

Figures 3, 7:
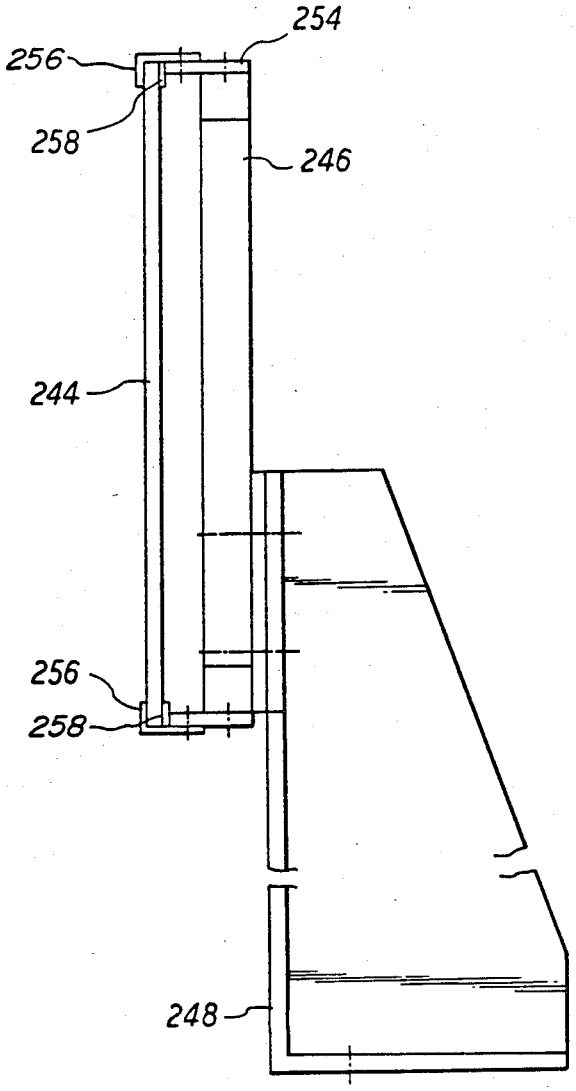

The processing device 400 includes a video signal processing-control circuit 500 which will be described in detail with reference to FIG. 9 and analyzes the diameter, visible damage and color of each orange. FIGS. 3-1 and 3-2 show the outer appearance of the processing device 400. The processing device 400 includes a main control panel 401, a sub-control panel 402, a video signal processing panel 403, a power supply 404, a terminal plate 405 and a blank panel 406 inserted between the sub-control panel 402 and the video signal processing panel 403. These panels 401 through 406 are housed in a rack 407. The processing device 400 further includes a rotary alarm lamp 408.

Figure 4:
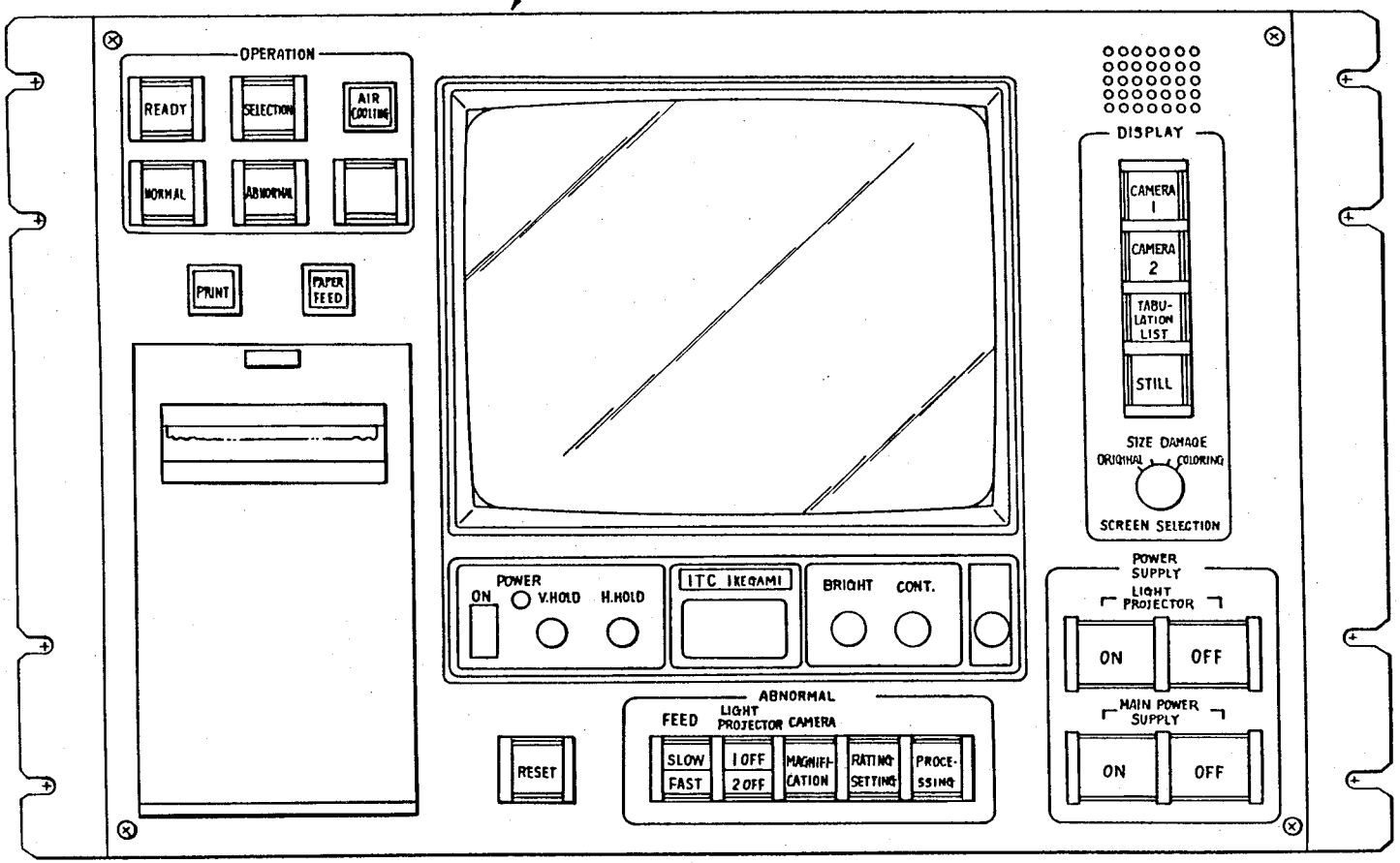
FIG. 4 is a front view showing, on enlarged scale, an embodiment of a main control panel of a processing device as shown in FIG. 1.

FIG. 4 shows the detail of the main control panel 401 while FIG. 5-1 shows the detail of the sub-control panel 402.

Referring first to FIG. 5-1 showing the sub-control panel 402, the functions of the orange sorting system in accordance with the present invention will be described.

Classification (Orange diameter)

1. Two cameras which are arranged on right and left sides of the conveyor belt are used to measure the height and width of each orange to compute the average of the height and width. The diameter of each orange is defined as a height when it is greater than width or as a width when it is greater than the height. The oranges are sorted according to their diameters (See FIG. 5-2)

Width: $(W_1+W_2)/2$

Height: $(H_1+H_2)/2$

2. The oranges are classified into LL, L, M, S, SS and poor (or out of classification). These classifications can be preset by a digital switch on a classification tabulating panel. The increment may be 1 mm and the maximum value may be 127 mm.

3. "GRADES" are set by the classification tabulating panel shown in FIG. 5-1.

That is, the oranges are classified as follows:

LL L M S SS>inferior

It should be noted that the grades can be set at any desired amount. A unit setting may be one millimeter (mm); that is, the oranges can be classified between 000 and 127 mm. However, the oranges with a diameter higher than 127 mm are regarded as oranges with the diameter of 127 mm.

FIG. 5-3 shows the relationship between an orange diameter or size and a group of setting switches on the control panel. If a grade is erroneously set as indicated by the broken line, the erroneous setting is warned by the flashing or lighting the rotary alarm lamp 408 in FIG. 3-1.

Sorting depending upon visible damages:

1. In order to sort the oranges depending upon their visible damages, "DAMAGE" is set on the panel shown in FIG. 5-1.

2. The surface damage of each orange is inspected from both side directions thereof and the orange is classified depending upon its visible damage in terms of an injured area. Thus, the oranges are classified into four grades of "excellent", "good", "fair" and "poor". The area is calculated in terms of picture elements; that is, an area including 100 picture elements nearly corresponding to 6 $mm^2$. The number of picture elements to be measured is within the range of 0–300. If an area includes more than 300 picture elements, the area is counted as having 300 picture elements.

3. The number of picture elements corresponding to each grade can be set under the condition that the sequence of such grades satisfies the order of "excellent", "good", "fair" and "poor".

The number of picture elements to be set in the example is within the range of 0–300.

FIG. 5-4 shows the relationship between the grades; that is, the degree of visible damages and the setting switch group. When the grade setting is erroneously made, the erroneous setting is warned by lighting the lamp 408.

Coloring Classification:

1. In order to classify the oranges depending upon their colors, "COLORING" is set on the panel shown in FIG. 5-1.

2. The ratio between the intensity of the totally reflected light reflected from the surface of each orange and the intensity of the green light reflected from the surface of the same orange is divided into 64 levels. The level histogram for each measuring point is prepared which can be displayed on a monitor display and the center value of the histogram is defined as the coloring of the orange. In this manner, the coloring of oranges can be defined objectively.

3. The orange coloring can be classified into four grades of "excellent", "good", "fair" and "poor". The color classification can be set into 63 steps by means of digital switches on the classification tabulating panel shown in FIG. 5-1.

FIG. 5-5 shows an example of such a histogram. In FIG. 5-5, the greenish orange shows the histogram indicated by the solid lines, while the less greenish orange or matured orange shows the histogram as indicated by the broken lines.

The level in FIG. 5-5 is defined as follows:

Level=(the intensity of the totally reflected light)/(-the intensity of green light reflected from an orange).

Referring now back to FIG. 1, the sorting device 600 has air jet nozzles 601-1, 601-2 and so on which are alternately disposed on the opposite sides of the conveyor belt 301 at a fixed distance. The orange receiving boxes 602-1, 602-2 and so on are disposed in opposed relationship with the air jet nozzles 601-1, 601-2 and so on. The orange transportation timing is determined as will be described hereinafter. In response to the output from the processing device 400, a predetermined nozzle 601 is activated when an orange is brought to the opposed relationship therewith, so that the orange is dropped into the box 602 by the air jet issued from the air jet nozzle 601. Therefore, the oranges are sorted into the boxes 602-1, 602-2 and so on according to their grades. However, those oranges whose grade is "poor" are transported by the conveyor belt 301 without being sorted into the boxes 602 and accordingly discharged at the end of the conveyor belt 301.

TABLE 1 shows how the oranges are classified, graded and sorted in accordance with the present invention. As shown in TABLE 1, there are provided ten air jet nozzles in the embodiment, so that the oranges are sorted into 11 grades as indicated in the item of "sorting". The sorting of oranges is effected depending upon "size classification", "visible damage classification" and "coloring classification" as indicated in the "classification item". The oranges are sorted depending upon size, visible damage or coloring by depressing a suitable selection button in "sorting item" on the sub-control panel as shown in FIG. 5-1. The total number of oranges processed and each number of oranges sorted into each grade are indicated by one of 12 counters disposed at the lower half portion of the sub-control panel 402.

TABLE 1-1

| Items | Grades | | Classification method | Function |
|---|---|---|---|---|
| | | | Sorting Performance | |
| Classification | | | | |
| classification (size) | LL<br>L<br>M<br>S<br>SS<br>poor | 6 grades | arbitrarily selected (from 1 to 127 mm, one step = 1 mm) | Two cameras are used to measure the width of a fruit and an average is obtained. When the height is greater than width, the former is defined as the size of the fruit and vice versa. The fruits are classified into six grades according to their sizes. If the classification setting is erroneously carried out, a warning lamp is flashed. A fruit whose size is greater than 127 mm is regarded as having the size of 127 mm. |
| Classification according to visible damage (damage) | excellent<br>good<br>fair<br>poor | 4 grades | arbitrarily selected (0–300) | A fruit is inspected from both sides. Visible damages are defined in terms of area. According to visible damages, the fruits are classified into four grades. The area is represented by the number of picture cells. 100 picture cells correspond to 6 $mm^2$. The measured picture cells higher than 0–300 are regarded as 300 picture cells. If classification is erroneously set, a warning lamp is flashed. |

TABLE 1-1-continued

| Items | Grades | Classification method | Function |
|---|---|---|---|
| Classification according to coloring (maturity) | excellent 4 grades<br>good<br>fair<br>poor | arbitrarily selected (1–63 steps) step | The ratio between an amount of the visible light reflected back from the surface of a fruit and the amount of green light reflected back from the surface of the fruit is divided into 64 levels. A histogram is provided and the center value of the histogram is defined as representing the color of the fruit. The fruits are classified according to their coloring. If coloring classification is erroneously set, a warning lamp is flashed. |

TABLE 1-2

| Items | Nozzle No. | | | | | | | | | | |
|---|---|---|---|---|---|---|---|---|---|---|---|
| Grade Classification | | | | | | | | | | | |
| classification | 601-1 | 601-2 | 601-3 | 601-4 | 601-5 | 601-6 | 601-7 | 601-8 | 601-9 | 601-10 | poor |
| classification only according to size | LL | | L | | M | | S | | SS | | poor |
| classification only according to visible damage | excellent | | good | | fair | | | | | | poor |
| classification only according to coloring | excellent | | good | | fair | | | | | | poor |
| damage and coloring | all | | the worse | | the worse | | | | | | poor |
| grades | "excellent" | | grade is "good" | | grde is "fair" | | | | | | poor |
| overall grade | LL excellent | LL good | L excellent | L good | M excellent | M good | S excellent | S good | SS excellent | SS good | poor |

Processing Capacity

| Item speed | rating | belt speed (m/sec) | number of processed fruit per second | precessed fruits tons per 10 hours per one inspection line |
|---|---|---|---|---|
| standard | continuous | 35 | 5 | 18.9 (average weight of one fruit: 105 grams) |
| high speed | continuous | 45 | 7 | 26.0 |

TABLE 1-3

Sorting Performance

| Automatic checking capacity | Totalization | | | |
|---|---|---|---|---|
| Electromagnetic counter | Classification into 1–10 grdes and the total result is obtained. The total result of the poor is also obtained. 12 counters (each 6 digits) are used for obtaining the total result. The counters are resetable | | | |
| Journal printer | Printing. The total result can be printed out at any time by depressing a "PRINT" button. | | | |
| Monitor display | Lists of the total result. The list can be displayed on a monitor display at any time by depressing a "MONITOR" button. | | | |
| Ready | Preparatory processing such as warming up of the system is effected. | | | |
| Sorting | Indicating that all the system is sorting fruits. | | | |
| Normal | Indicating that all the system is operating normally. | | | |
| Abnormal Item | abnormal belt speed | breakdown of projector lamp | abnormal classification setting | abnormal processing |
| | The belt speed is always checked. If the speed becomes faster or slower than a predetermined speed, the abnormal speed is displayed on a monitor display. | Check the projectors for cameras 1 and 2. | Check the settings of grade classification digital switches. | Check each processing system. |
| Air cooling | Indicating that the projectors and the like are being cooled after the main power supply is de-energized for 10 min. | | | |

TABLE 1-4

| Display | Main functions | Camera 206 | Camera 216 | Still |
|---|---|---|---|---|
| | Sorting Performance | | | |
| Monitor display function | | | | |
| Image selection | | | | |
| original image | Original camera image of 64 tones is displayed (Picture cells of ¼ of the processing | image from camera | image from camera | Upon depression of this button, a still image of |

TABLE 1-4-continued

| Display | Main functions | Camera 206 | Camera 216 | Still |
|---|---|---|---|---|
| | original image are displayed.) | 206 | 216 | a fruit is displayed. |
| size | white and black binary values. ¼ of the processing image cells are displayed. | image from camera 206 | image from camera 216 | |
| visible damage | white and black binary values. ¼ of the processing picture cells are displayed. | image from camera 206 | image from camera 216 | |
| coloring | displayed by histogram. | accumulated display by camera | | |
| | reference coloring selection. | | | |
| Belt speed display | The belt speed is displayed by a cursor at the upper portion of the monitor display. | | | |
| Classification & grade data | Classification and grade of each orange is displayed at the right bottom portion of the monitor display. | | | |
| Total list | The total result of each grade is displayed. | | | |

Furthermore, when suitable switches are depressed on the main control panel shown in FIG. 4 with reference to items shown in TABLE 1, "automatic inspection" and "monitor display" can be effected. At the same time, the image of an orange being inspected is displayed.

FIG. 6 shows an embodiment of a whole optical system of the present invention. Reference numeral 201 designates projector having, for example, a 1W halogen lamp; and 202, a mirror which is adapted to pass the infrared ray of the light emitted from the projector 201, to reflect the remaining visible light to an object to be inspected or orange 204 and to direct the light reflected back from the orange 204 toward the camera 206. The mirror 202 is provided with a slit and is best shown in FIGS. 7-2 and 7-3.

In order to detect the time when an orange 204 is brought immediately in front of the camera 206, a pair of light emitter 208P (also called PH1 light emitter) and light receiver 208R (also called PH1 light receiver) are disposed in opposed relationship with each other. As will be described in detail, it is preferable that the camera 206 is equipped with two kinds of CCD line image sensors.

According to the present invention, the whole surface of an orange 204 are inspected with respect to size, visible damage and coloring, so that a projector 212, a reflecting mirror 214 and the camera 216 with two CCD line sensors are also provided. Furthermore, in front of the camera 216 there are disposed a pair of light emitter 218P (also called PH2 emitter) and light receiver (also called PH2 light receiver).

FIG. 7-1 is a top plan view of the optical system shown in FIG. 6. The optical system further includes a base or bench 220, a fan 222, camera stands 224 and 226 and photosensors 228 and 230 for sensing amounts of light emitted from the projectors 201 and 212, respectively. The mode of operation of the sensors 228 and 230 will be described hereinafter with particular reference to FIGS. 9-1A and 9-1B. In order to detect amounts of lights emitted from the projectors 201 and 212, respectively, the light sensors 228' and 230' may be disposed behind the mirrors 202 and 214 as indicated by the broken lines, respectively. In the latter case, in order not to receive the light reflected back from the orange 204, suitable light shielding means (not shown) must be provided.

FIG. 7-2 shows, on enlarged scale, a sectional view of the reflecting mirror 202. The reflecting mirror 202 has mirror elements 240, 242, 244 and so on, a mirror stand 246, a mirror holder 248 and flat plates 250, 252 and 254.

FIG. 7-3 shows a sectional view taken along the line A—A' of FIG. 7-2. It is seen that the reflecting mirror 202 further includes mirror holders 256 and rubber plates 258.

Next, the optical system will be specifically described in detail.

(1) Various sensors are available at present, but in view of the maximum speed of the driving clock, the relative sensitivity curve and cost, it is preferable to use $C^4D$ (Conductively Connected Charge Couple Device) type. $C^4D$ has 1024/2048 picture cells but the most preferable is 1024 bit $C^4D$, type CCD133.

(2) The scanning speed (processing capacity) as well as the light amount must be taken into consideration in the present invention. It is well known that if an exposure time of a line sensor is shortened, it is required that an amount of the light must be increased so as to ensure to obtain a predetermined CCD output level. For instance, when an automatic outer appearance inspection system has a processing speed or rate of 5 pieces per second, it must process about 1.9 ton per hour, if an average weight of one orange is 105 grams.

Manual sorting at present depends on the size of a sorting section. For example, in the busiest season for oranges, a processing capacity at a small-sized sorting section is a few tons per hour, while a processing capacity is 20 to 30 tons per hour at a large-sized sorting section.

Usually, 10% of the oranges supplied from the suppliers are sampled and evaluated by inspectors in such a sorting section.

In view of the above, the processing capacity of the orange sorting system for determining the grades of oranges is obtained as follows.

$$(\text{a few tons to 30 tons}) \times 0.1 \leqq 3 \text{ tons/H}$$

Therefore, it follows that if one or two orange sorting systems in accordance with the present invention are installed, oranges can be satisfactorily inspected and sorted.

(3) As regard to depth of focus, the position of the center of the orange 204 and the defocusing of the orange surface skin due to the fact that the orange surface is spherical must be taken into consideration as shown in FIG. 8-1. The orange must be conveyed by the conveyor belt 301 in such a way that the center of the orange 204 is positioned precisely to the center line of the conveyor belt 301, but as to the defocusing of the orange 204, the depth of focus must be taken into consideration in the case of designing the optical system. Assume that the maximum diameter of orange is 100 mm; that is, the radius r is 50 mm and that the deviation $d_1$ or $d_2$ of the position of the center of the orange 204 from the center line of the conveyor belt 301 is ±50 mm. Then, the depth of focus becomes about ±75 mm.

(4) The solid-state image sensors such as MOS, CCD have such characteristics that they are most sensitive to the red light and the infrared ray. Therefore, according to the experiments, it is preferable to use a bandpass filter having a wavelength within a range of 490–530 mm as a color separation filter for extracting the blue light component.

Assume that the output of the CCD which receives the whole visible light is W and the output of the CCD which receives the light transmitted through the blue-light bandpass filter is G. Then, the following relationship is established by multiplying W and G with suitable constants and dividing G by W $$C=G/W$$

Therefore, the color-wavelength vs. C curve can be drawn as shown in FIG. 8-2, so that the separation characteristic can be obtained. Here, a region SD means that color separation is difficult in this region. As a result, a suitable filter may be selected in accordance with this characteristic curve.

(5) Compensation for blue-light sensitivity:

An amount of green light is considerably decreased relative to W output because a green filter is inserted and the sensitivity to green light of a CCD image sensor drops. That is, the output G is considerably lower than the output W.

Even if an amplifier may be inserted to enhance the output G, a signal to noise ratio is adversely affected.

As compared with the sensor for detecting visible damages, the color sensor is designed to have a slow scanning speed and a rough vertical resolution.

Because of the insertion of a green filter, the output G becomes about 1/6 time as low as the output W.

It follows, therefore, that a response of the same level is obtained, if the line scanning speed is 1/6 of the output W.

As shown in FIG. 8-3, however, when green light is focused on a green light sensor G-SNS by using spectrographic beam splitter BS, it is impossible to obtain the amount of light required for a high processing scanning when the spectral ratio between the lights $T_{HG}$ and $T_{HW}$ obtained by the beam splitter BS, respectively, toward the green light and the whole visible light are the same ($T_{HG}=T_{HW}$).

In FIG. 8-3, the green-light sensor G-SNS receives a green light from a filter FIL and the sensor W-SNS senses the output W. The light must be divided by the beam splitter BS in such a way that $T_{HW}>T_{HG}$, whereby a sufficient output W must be obtained in order to detect the visible damages.

The post processing such as the inspection of visible damages in response to the output G and the monitor display must be taken into consideration. Therefore, the outputs W and G must be obtained from the same position and furthermore, the magnification must be the same. Thus, the optical system in which the green light is not separated cannot be used in practice.

Therefore, it is preferable that the scanning speed of the green light sensor is reduced as low as possible in practice and an insufficient output is preferably amplified by the succeeding stage.

In the case of detecting visible damages on the surface of an orange, it is preferable that a scanning distance of the whole visible light sensor is 0.2–0.3 mm, while a scanning distance of the green light sensor is 0.8–1.2 mm (a scanning speed is about ¼ times as low as a scanning speed of the whole visible light sensor) (See FIG. 8-4).

Assume that the mirror ratio be $T_{HW}:T_{HG}=7:3$. Then, the ratio between G and W becomes $$W:G = 1:1/6 \times 3/10 \times 4$$
$$= 1:0.2$$

A filter is so selected that the ratio 1/6–¼ may be satisfied. Furthermore, the scanning speed of the green light sensor may be reduced. However, it should be noted that the green light sensor is also used in order to detect visible damages, so that the scanning speed cannot be lowered too much.

FIGS. 9-1A and 9-1B show block diagrams of a video information processing/control circuit 500 for controlling the orange sorting system in accordance with the present invention in response to the output obtained by processing the video signal derived from the optical system 200. The circuit 500 is incorporated in the processing device 400. As described before with reference to FIGS. 6–8, halogen lamps are used as the projectors 201 and 212. The lights emitted from such projectors 201 and 212 contains infrared rays; i.e., heat radiation. Thus, the infrared rays adversely affect an object to be inspected; that is, an orange. Furthermore, the CCD in the cameras CM1 and CM2 are very sensitive to the infrared rays. Moreover, when the visible light contains infrared ray, it is difficult to detect visible damages of an object surface to be inspected; that is, an orange surface. Therefore, the mirrors 202 and 214 which are transparent to infrared ray are arcuately disposed around the center of the conveyor belt 301 and on both sides of the belt 301, so that the light excluding the infrared ray will be incident upon the orange on the conveyor belt 301 and that the infrared rays are passed through the mirrors 202 and 214.

The light sensors OPT1 and OPT2 are disposed so as to receive the light rays emitted from the projectors 201 and 212, thereby measuring amounts of light emitted therefrom. The outputs from the light sensors OPT1 and OPT2 are applied to a light amount control unit 502. The light amount control unit 502 normally monitors the intensities of lights emitted from the projectors 201 and 212, so that the orange 204, which is an object to be inspected, may uniformly be illuminated. For instance, when the intensities of lights emitted from the projectors 201 and 212 are reduced, the intensity of light received by the light sensor OPT1 or OPT2 is also reduced. Therefore, the light amount control unit 502 controls the projector 201 or 212 in such a way that the intensities of lights emitted from the projector 201 or 212 are increased. Thus, the orange, which is an object to be inspected, is always uniformly illuminated.

In a case that the light sensors OPT1' or 228' and OPT2' or 230' are disposed at the positions indicated by the broken lines in FIG. 7-1, the projectors 201 and 212 can optimumly be controlled, even when the mirrors 202 and 214 become dim and accordingly the light amounts are reduced.

The air blown by the blower 222 is directed to the mirrors 202 and 214, so that dust particles will not adhere to the mirrors and consequently the mirrors 202 and 214 can be prevented from being dimmed. Optoelectronic switches PH1 and PH2 are disposed in the vicinity of the cameras CM1 and CM2 in order to detect the passage of the oranges. That is, a light source and a light receiver are disposed in opposed relationship with each other on both sides of the conveyor belt 301 so as to detect the passage of an orange 204. The optoelectronic switches PH1 and PH2 generate signals whenever an orange enters and leaves the fields of view of the cameras CM1 and CM2. The output signals thus obtained are transmitted to an interface 504. That is, by detecting a position of the object 204, for example, whether or not the orange 204 is passing in front of the optoelectronic switch PH1 and is within the field of view of the camera CM1, or whether or not the orange 204 is not passing in front of the optoelectronic switch PH1 but is within the view of field of the camera CM1, each image of each orange can be processed, even if the distance between the adjacently transported oranges is very narrow, for instance less than 10 mm.

A conveyor belt driving unit 350 is provided with a rotary position sensor such as a rotary encoder (not shown), so that one pulse is generated every time that the conveyor belt 301 advances by 1 mm. The output pulse is applied to the interface 504, so that the speed of the conveyor belt 301 and the time that an orange reaches a sorting position 1, 2, 3 . . . or N is detected. As a result, in response to the output transmitted through a shift register 506 from a master control processor 570, a solenoid valve driving unit 508 is actuated, so that depending upon the results of the inspection of an orange, a selected nozzle of the air jet nozzles 601-1, 601-2, 601-3,—and 601-N at the N sorting sections ejects an air jet against the center of gravity of the orange, whereby the orange is sorted into a predetermined box among boxes 602-1, 602-2, 602-3,—and 602-N (See FIG. 1 or 9-1A).

Video signals derived from the cameras CM1 and CM2 are applied to waveshaping circuits 510, 512, 514 and 516. Prior to the A/D conversion of the waveforms obtained by sweeping the CCD image sensors, these waveshaping circuits 510, 512, 514 and 516 shape the waveforms in analog system, so that the succeeding processing of the signals may be facilitated in the video signal processing control circuit 500.

The waveshaping circuit 510 is for processing the visible damage of an orange 204 which is an object to be inspected. The video signal representative of the visible damage of the orange is applied to an A/D converter 520. In order to inspect the visible damage of the orange 204, the waveshaping of the following five items are taken into consideration:

(1) Parabolic correction:

The orange is in the form of sphere and when an orange as shown in FIG. 9-2A is uniformly illuminated and scanned, a rectangular waveform is derived, but in practice, the rising and falling edges of the rectangular waveform are sloped as shown in FIG. 9-2B. Therefore, a downward parabolic curves from scanning start A to center scanning B are superposed, so that the correction can be effected.

(2) Misjudgement of damage due to the difference in level between the green region (output G) and the visible light region (output W):

The orange has various colors mixed in a range from green to orange. The CCD image sensor is very sensitive to the orange light and its sensitivity is lowered as the color of the orange approaches to the green light. Furthermore, the sensitivity of the CCD image sensor drops when the orange has a visible damage. Therefore, in order to distinguish the green region from the visible damage, the waveform is reshaped by a circuit shown in FIG. 9-3.

(3) Small projections of the orange:

The surface of an orange has many small projections, so that the waveform is reshaped so as to eliminate the signals representative of such small projections.

(4) Reflection:

Regardless of the direction of the axis of the light projection, halation inevitably occurs. Therefore, the halation must be eliminated.

(5) Variations in video signal due to flickering of the projectors 201 and 212:

The variations in power supply voltage applied to the projectors 201 and 212 adversely affect the data obtained. When AC 100 V is applied to the projectors 201 and 202, the CCD image sensor rapidly reads the image of an orange. As a result, flickering of the projectors 201 and 212 exists in the camera video signal as a varying component. As a result, the detection of visible damage becomes difficult. Thus, it is necessary that flickering must be eliminated.

In order to solve the first problem, as shown in FIG. 9-3, the video signal is caused to pass through a low pass filter 1001 and then one-horizontal-scanning-time (1H) delay circuit 1002. The video signal and the 1H delay output from the time delay circuit 1002 are applied to an adder 1003, so that the signal waveform can be corrected.

Figures 3, 4A, 4B, 5A, 5B, 12:
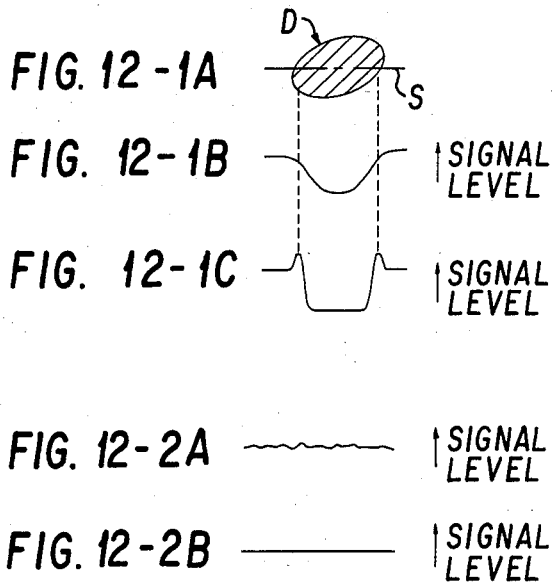
Figures 6, 12:
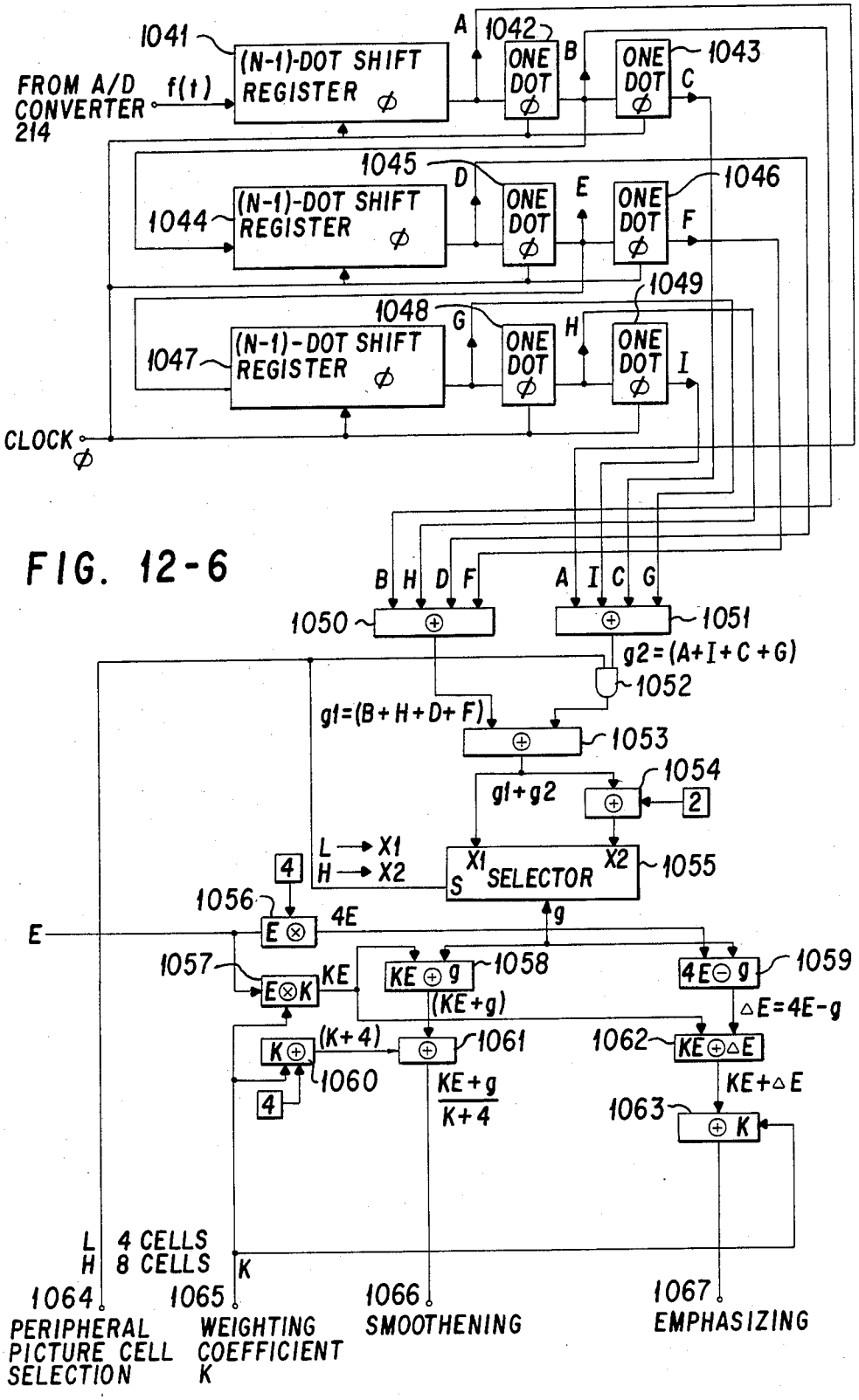

Furthermore, an average correction curve is stored in a read-only memory and, as shown in FIGS. 9-4A and 9-4B, is superposed to the video signal waveform, whereby the correction can be effected. In view of cost and steps, it is not preferable to store a plurality of average or reference curves in a single read-only memory. Therefore, as shown in FIG. 9-5A, only the reference curve Co which represents the equator of the orange with the largest size Lo is stored in the read-only memory. Other reference curves are generated by a circuit as shown in FIG. 9-5B depending upon the size L of an orange. Furthermore, the corrected curve is shifted to the L/2 point.

In FIG. 9-5B, reference numeral 1010 designates a read-only memory in which the reference curve Co is stored; 1011, an arithmetic unit for changing the data of the reference curve Co read out from the read-only memory 1010; 1012, a shifting circuit for shifting the reference curve obtained from the arithmetic unit 1011 to the L/2 point; 1013, a digital-to-analog converter for converting the digital data of the reference curve which has been obtained from the shifting circuit 1012 into the analog data; and 1014, an adder to which the output from an A/D converter 1013 and the video signal are applied.

In order to solve the second problem, as shown in FIGS. 9-6A and 9-6B, the correction is effected by adding to the video signal waveform the gain which is proportional to C/W. If the ratio C/W is outside the tolerable range as shown in FIG. 9-6C, the orange is detected as having a visible damage.

As to the third problem, the video signal as shown in FIG. 9-7A is caused to pass through a low pass filter 1021, so that the peaks representative of small projections of the surface of the orange are eliminated. The output from the low pass filter 1021 is delayed by one horizontal scanning period (1H) by a 1H time-delay circuit 1022 as shown in FIG. 9-7C. The output from the time-delay circuit 1022 is applied to a clipper 1023, whereby the signals representative of the small projections of the orange are eliminated.

The waveshaping circuit 512 is a circuit for obtaining the waveform representative of the outer appearance of the orange. That is, in order to measure the maximum size of the orange, the waveform representative of only the profile or outline of the orange is devised.

The waveshaping circuits 514 and 516 are used to detect the color of the orange. For instance, the gains are matched by green and orange colors. Furthermore, they balance the colors detected by the cameras CM1 and CM2.

Reference numerals 511, 515 and 517 designate switches, respectively, for selectively deriving the signals from the camera CM1 or CM2.

Figure 10:
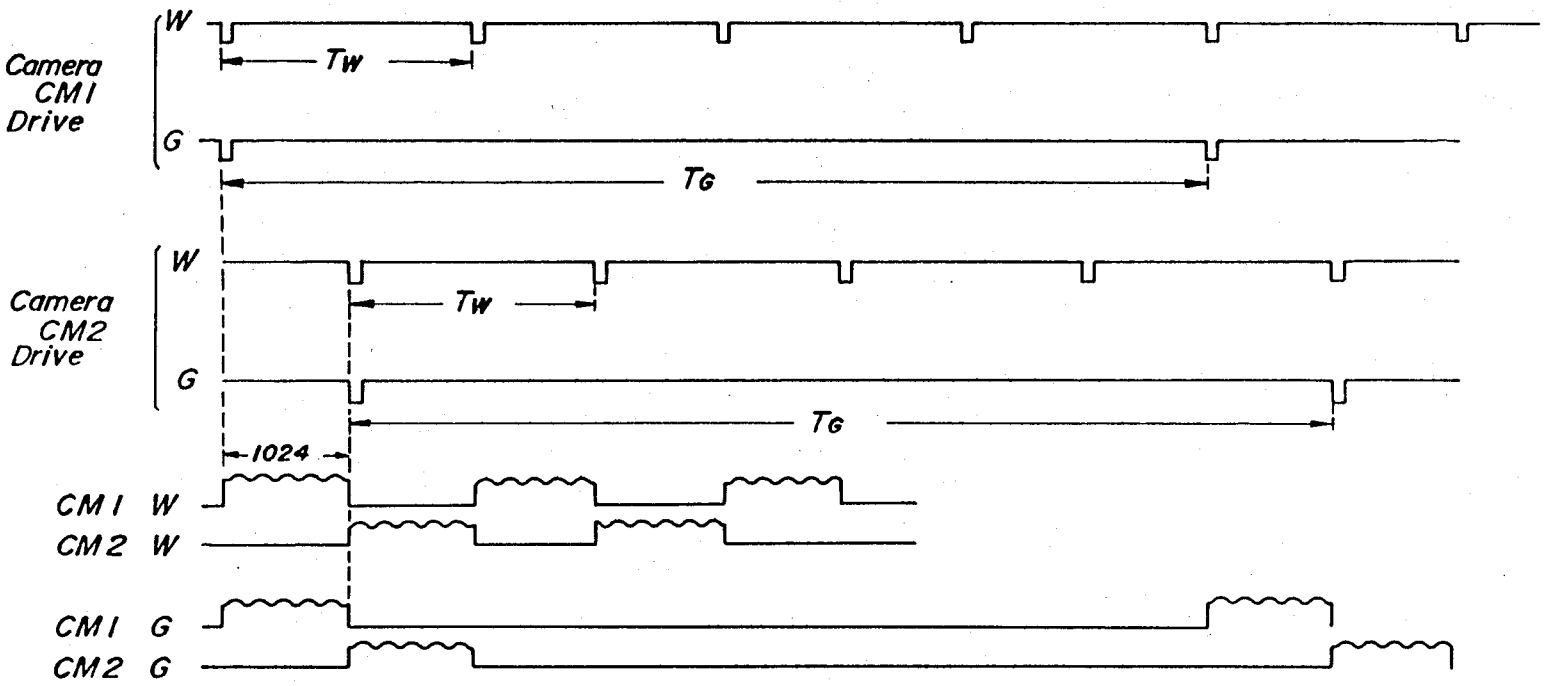
FIG. 10 is a timing chart to explain operations of the arrangement shown in FIGS. 9-1A and 9-1B.

According to the present invention, the scanning time of the camera CM1 is allotted to the integration time of the camera CM2; that is, to the time for storing the light and the camera driving signals are alternately applied to the cameras CM1 and CM2 as shown in FIG. 10. That is, the camera CM2 receives the driving signal after the driving signal is applied to the camera CM1, so that the CCD image sensor delivers the signal CM1W representative of, for instance, 1024 picture cells. That is, the frequency of the clock signal applied to the CCD image sensor is so selected that the above-described operation may be carried out. According to the present invention, after the camera CM1 has delivered the signal W, the driving signal is applied to the camera CM2 and after the camera CM2 has delivered its output signal W, the driving signal is applied to the camera CM1. Therefore, when the output signals from the CCD image sensors are selected by means of the switch 511, one time sequential signal is detained in which the output signals from the cameras CM1 and CM2 are alternately produced.

Next, the signal G will be described. As shown in FIG. 10, the storage time is four times as long as the signal W with respect to the driving signal. Let Tw denote the storage time of the signal W and let $T_G$ the storage time of the signal G. If the relationship $T_G=4\times Tw$ is satisfied, even when an amount of light drops, the sensitivity to the green light is enhanced because the storage time $T_G$ is sufficiently long.

Referring back to FIGS. 9-1A and 9-1B, the outputs from the switches 511, 515 and 517 are applied to A/D converters 520, 524 and 526, respectively. In this embodiment, six-bit A/D converters are used so that the analog signal is divided into 64 levels or tones. The output from the waveshaping circuit 512 is applied to a binary encoder 522 which is shown in detail in FIG. 11-1. For each horizontal scanning period, the black level of the background is applied to a sample-hold circuit 1030, so that a threshold value is determined. The output from the sample-hold circuit 1030 is applied to a comparator 1031 and compared with the output signal W. Thus, as shown in FIGS. 11-2A and 11-2B, the profile data at the positions A and B are derived.

Referring back again to FIGS. 9-1A and 9-1B, the output of the A/D converter 520 is applied to a pre-processing circuit 530 which effects the smoothening of the signal and the emphasizing of the outline as will be explained with reference to FIG. 12-1. The pre-processing circuit 530 delivers a micro visible damage signal and macro visible damage signal to a micro and macro visible damage detectors 532 and 534, respectively.

Here, a micro damage is a damage having a small damaged area, whereas a macro damage is a damage having a large damaged area. In the present invention, in case of macro damage detection, a small differential change is eliminated by smoothening the level change and the local maximum and the local minimum of the smoothened level change are detected so that the region between the local maximums on the opposite sides of the local minimum is treated a macro damage area. On the other hand, in case of micro damage detection, the outline of a picture cell is emphasized to detect a small or micro damage easily and a portion in which the difference between an average value of a small area and the central value of the small area exceeds a reference is treated as a micro damage area.

The outline-emphasizing is processed as follows. The difference between the central picture cell to be emphasized and its peripheral picture cells is obtained as outline information. This outline information is added to the information at the central picture cell to be emphasized to emphasize the outline. As a result, the level change in the vicinity of the boundary of an orange is emphasized as shown in FIG. 12-1, so that the outline portion is made clear and accordingly it is ensured that even a small defect is detected.

In the smoothening process, an average value of the information of the peripheral picture cells is obtained, so that a small differential change as shown in FIG. 12-2A is eliminated, thereby the signal level change is smoothed. As a result, noises due to the surface of an orange and produced in the optical conversion system or the like are removed.

More specifically, in case of emphasizing information in a central picture cell E in a 3 columns-3-rows picture cell arrangement shown in FIG. 12-3, its peripheral or up, down, right and left picture cells B, H, D and F should be considered to obtain the following value $g_1$.

$$g_1=B+H+D+F \quad (1)$$

If the picture cells A, I, C and G in the 45° directions are further considered, the following value $g_2$ should also be taken into consideration.

$$g_2=A+I+C+G \quad (2)$$

In case of 4 picture cells, the following g is obtained.

$$g=g_1 \quad (3)$$

In case of 8 picture cells, the following g is obtained.

$$g=\tfrac{1}{2}(g_1+g_2) \quad (4)$$

The outline information ΔE is obtained as follows.

$$\Delta E=4E-g \quad (5)$$

Thus, the outline-emphasized picture cell information F(t) is $$F(t)=E+\Delta E \quad (6).$$

When E is weighed by a coefficient K, the following F(t) is obtained, $$F(t)=\frac{1}{K}(KE+\Delta E) \quad (7)$$

FIGS. 12-4A and 12-4B show the factors by which each of the picture cell information is multiplied when K=1. The value of the outline-emphasized picture cell information is the sum of the products of the picture cell information and the factors.

As to the smoothing process, the smoothed information of the picture cell F(s) is obtained as follows from g as defined by equations (3) and (4), when a weighting coefficient with respect to the central picture cell E is K.

$$F(s)=(KE+g)/(K+4) \quad (8)$$

FIGS. 12-5A and 12-5B show the factors by which each of the picture cell information is multiplied when K=4. The value of the smoothed picture cell information is the sum of the products of the picture cell information and the factors.

FIG. 12-6 shows an embodiment of a smoothening and outline-emphasizing circuit which performs the above-described smoothening and outline-emphasizing processes. When the number of the picture elements per one scan of input picture cell information f(t) is N, the input information is applied to the series circuits of an (N−1)-dot shift register 1041 and one-dot shift registers 1042 and 1043. The output from the shift register 1042 is applied to the series circuit of an (N−1)-dot shift register 1044 and one-dot shift registers 1045 and 1046. The output from the shift register 1045 is applied to the series circuit of an (N−1)-dot shift register 1047 and one-dot shift registers 1048 and 1049. The respective output from the shift registers 1041–1049 represents picture cell information A–I.

The picture cell information B, H, D and F is applied to an adder 1050 to compute equation (1). The picture cell information A, I, C, G is applied to an adder 1051 to compute equation (2). The outputs from the adders 1050 and 1051 are applied to an adder 1053 directly and via an AND gate 1052, respectively, to compute equations (3) and (4).

The peripheral picture cell selection, i.e., 4 picture cells or 8 picture cells is controlled by applying an input from a terminal 1064 to the AND gate 1052. If the input is L, the AND gate 1052 is interrupted, so that the output from the adder 1053 is $g_1$, while the output from the adder 1053 is $(g_1+g_2)$ when the input at the terminal 1064 is H.

Such an adder output is applied to a selector 1055 directly or via a divider 1054 which divides the adder output by two. The selector 1055 receives the selection signal from the terminal 1064. In case of 4 picture cells, the selector 1055 outputs $g_1$, while the selector 1055 outputs $\frac{1}{2}(g_1+g_2)$ in case of 8 pictures.

The central picture cell value E is applied to multipliers 1056 and 1057 and the weighting coefficient K is applied to the multiplier 1057 and an adder 1060. The multiplier 1056 multiplies E by 4 to obtain 4E. The multiplier 1057 multiplies E by K to obtain KE. The adder 1060 adds 4 to K to obtain (K+4). The product KE and g from the selector 1055 are applied to an adder 1058 to produce (KE+g). The sums (KE+g) and (K+4) are applied to a divider 1061 to form (KE+g)/(K+4). This quotient (KE+g)/(K+4) is derived from a terminal 1066 as a smoothening information.

The product 4E and g are applied to a subtractor 1059 to obtain outline information $\Delta E=4E-g$. This result ΔE and the product KE are applied to an adder 1062 to form KE+ΔE, which is further divided by K by a divider 1063, so that weighed outline information (KE+ΔE)/K is derived from a terminal 1067 connected to the divider 1063 as an outline-emphasized information.

Further, the selection of the number of picture cells, i.e., 4 or 8 and the selection of weighting can be made manually by judging a surface condition of a test subject such as orange. Alternatively, such selection can be made automatically.

The signal thus outline-emphasized by the preprocessing circuit 530 is applied to the micro visible damage detector 532, in which a micro visible damage is detected when a difference between an average level of the peripheral picture cells and a level of the central picture cell exceeds a reference value, as shown in FIG. 12-7. This detector 532 does not detect a macro visible damage. In the macro visible damage detector 534, the detected signals from the pre-processing circuit 534 are sequentially compared with each other, as shown in FIG. 12-8 to detect a level change, so that the local maximum and local minimum values are obtained. A macro damage is detected from the distributions of the local maximum and local minimum values. When there is no damage, the local maximum value exists, but there is no local minimum value. If there is a damage, the local minimum value is produced and thus it is judged that a macro damage exists between the peaks of the local maximum value on both sides of the local minimum value.

These results are obtained in a digital signal manner as shown in FIG. 12-8 in which L→R and R→L represent directions of the sequential comparison, i.e., from left to right and right to left, respectively.

The micro damage signal detected by the micro damage detector 532 and the macro damage signal detected by the macro damage detector 534 are applied to a logic filter 536, which removes an isolated noise and an isolated dropout of a picture cell as shown in FIG. 12-9 and in addition a large stain and a large dropout which cannot be eliminated as an isolated noise or dropout are eliminated. Furthermore, a noise component is eliminated by a low pass filter. When information of a central picture cell is "1" or "0" and each of the complements of information of up, down, right and left picture cells is 1 or 0, an isolated noise or a dropout is detected.

A stain or a dropout larger than an isolated noise or an isolated dropout is eliminated by determining a two-dimensional expansion of the detected picture cell information by a mesh filter and by judging that a noise or dropout having a size less than a predetermined dimensions does not constitute a damage, as shown in FIGS. 12-10A and 12-10B. The filter can be a low pass filter. Here, it is to be noted that the cut-off frequency of a macro damage filter is sufficiently lower than that of a micro damage filter.

Noise contained in the output signals derived from such detectors 532 and 534 is eliminated by the logic filter 536 and the output signals from the logic filter 536 are applied to a visible damage detection processing circuit 538.

The output from the binary encoder 522 is applied through a switch 523 to a logic filter 540. The logic filter 540, like the logic filter 536, eliminates an isolated noise and dropped picture cells and further eliminates a larger stain dropped picture cells or dropout which cannot be eliminated as an isolated noise or dropout. Therefore, the logic filter 540 produces the signal representative of shape data for size and the signal representative of shape data for masking. The signal representative of the shape data for masking is applied to the visible damage detection-processing circuit 538 and the logical AND output of the micro and macro visible damage signals is derived. As a result, only an actual visible damage of orange can be detected.

The output of a W/G ratio circuit 548, which will be described in detail hereinafter, is also applied to the visible damage detection processing circuit 538, so that the boundary between the green color and the non-green color is detected. As a consequence, the green color region is not detected as a visible damage.

Figure 13A:
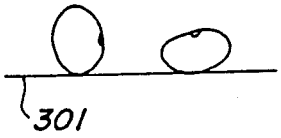
FIGS. 13A, 13B and 13C are views used to explain the measurement of the outer diameter of an orange.
Figure 13B:
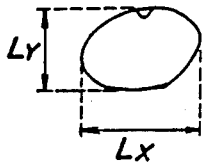
Figure 13C:
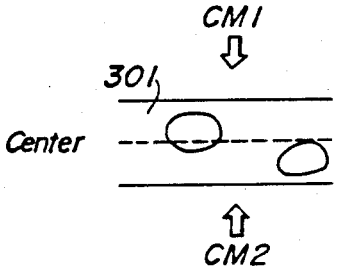

The output from the logic filter 540 is applied to an X-Y diameter separation measuring circuit 542. Since the equator or maximum diameter of an orange is sometimes vertical and sometimes horizontal, as shown in FIG. 13A, the X-Y diameter separation measuring circuit 542 measures the maximum diameters in the vertical (Y) and horizontal (X) directions. The longer diameter of the two maxmum diameters is treated as the diameter $L_x$ of the orange and the shorter diameter of the two is treated as the height $L_Y$ of the orange, as shown in FIG. 13B. The output of the circuit 542 is applied to a maximum diameter detector 544. In order to minimize the measurement errors due to the reduction and enlargement defocusing of camera output image depending on the position of the orange on the conveyor belt 301, as seen in FIG. 13C, the following data are obtained from Lx1, Ly1, Lx2 and Ly2 which are the values obtained by the measurement by the cameras CM1 and CM2:

$$L_x=(Lx1+Lx2)/2$$

and $$Ly=(Ly1+Ly2)/2$$

Lx is converted into the diameter Dx by computing the velocity of the conveyor belt and Ly is converted into the diameter Dy by computing the optical magnification. The diameters Dx and Dy are compared with each other and the greater diameter is defined as the maximum diameter.

The output signal W from the A/D converter 524 is applied to an averaging circuit 546. In case of obtaining the ratio between the signal W and the signal G, the distance between the adjacent scanning lines for obtaining the signal W is very dense as shown in FIG. 14A. That is, the distance is, for instance, 0.2 mm pitch. On the other hand, the distance between the adjacent scanning lines for obtaining the signal G is relatively wide and is, for instance, 1 mm pitch. As a result, the signal W is varied, so that the averaging circuit 546 is used to obtain an average value of the signal W. For instance, assume that four scannings are carried out in order to obtain the signal W. Then, the average value of the signal W is obtained as follows:

$$W=\sum_{i=1}^{4} Wi/4$$

The thus obtained average signal W is applied to the W/G ratio circuit 548. The output from the A/D converter 526 is also applied to the circuit 548.

In the W/G ratio circuit 548, the ratio W/G is obtained. Since the average signal W is compared with the signal G, the color ratio W/G can be obtained with a higher degree of accuracy in spite of the fact that the signal G is the integral value obtained by the rough scanning.

Figure 15A:
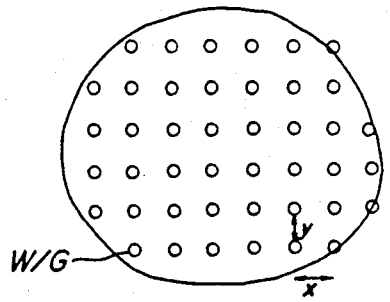
FIGS. 15A, 15B and 15C are views used to explain how the color of an orange is evaluated.
Figure 15B:
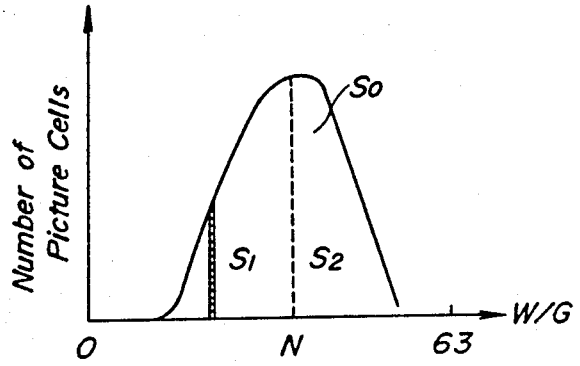
Figure 15C:
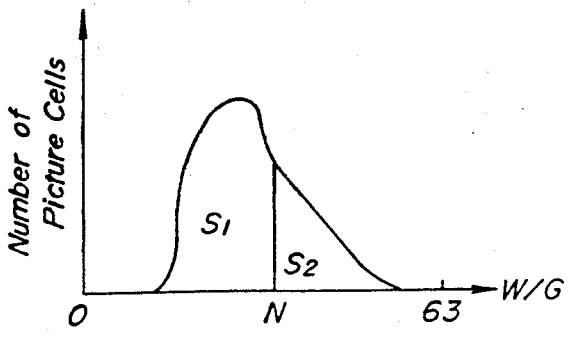

FIGS. 15A, 15B and 15C are views used to explain how to obtain a histogram of the W/G ratio derived from the W/G ratio circuit 548. FIG. 15A shows the method for measuring the ratios W/G over the picture cell points, which are spaced apart from each other by x in the horizontal direction and by v in the vertical direction, over the spherical surface of the orange. In FIGS. 15B and 15C, the number of samples, i.e., picture cells is plotted along the ordinate while the ratios W/G, along the abscissa. For instance, the ratio W/G is assumed to be between 0.5 and 2. The range between 0.5 and 2 is divided by 64 and the ratio less than 0.5 is defined as 0 while the ratio higher than 2 is defined as 63. In general, the quotient obtained by dividing (2−0.5) by 64 becomes one pitch of the abscissa and represents one level difference.

The surface of the orange includes a mixture of various colors ranging from green to orange, so that it is difficult to define the color of the orange. In general, one vaguely observes that an orange is greenish or orange. In order to approximate the human perception of the color of an orange, the present invention employs the following process. That is, the number So of total samples is equal to the area defined by the curves as shown in FIGS. 15B or 15C. Therefore, the output from a histogram measurement circuit 550 is applied to a color detection circuit 552. Next, the point is found out so that the area $S_1$ becomes equal to the area $S_2$ (See FIGS. 15B and 15C); that is, $S_1=S_2=So/2$. The number N (from 0 to 63) of this point is defined as the number representative of the color of an orange. In the case of FIG. 15C, the number N does not correspond to the peak value, but the point N which satisfies the condition $S_1=S_2=So/2$ is considered as representing the color of an orange.

The above described visible damage detection, computation of and correction for the maximum diameter and detection of the degree of color are controlled by micro control units 560,562 and 564, respectively. Various data are processed at a high speed by these micro control units.

Reference numeral 570 is a master control processor as described above. The master control processor 570 controls various units through a bus 571 as shown in FIGS. 9-1A and 9-1B. Reference numeral 572 designates an automatic operation unit which, for instance, warms up the projectors and so on for a predetermined time after the power supply is energized and drives the cooling fan so as to cool the optical system for a predetermined time after the power supply is de-energized. Reference numeral 574 designates an operation display unit which, for instance, displays a unit which fails to operate. Reference numeral 576 designates a summation memory which memorizes the number of oranges which are classified or sorted into a predetermined number, for instance 10, of grades. The sums of sorted oranges may be printed out by a printer 578, so that a total list is obtained. Reference numeral 580 designates a monitor memory display control circuit; and 590, a monitor display. The monitor display 590 displays the numbers of sorted oranges. In addition, it can display the surface condition of an orange, a histogram and the places at which the oranges are sorted.

The histogram of the W/G ratio derived from the W/G ratio circuit 548 is applied to the histogram measurement circuit 550. This circuit 550 is controlled by the micro control unit 564 via a bus 563. The signals from the micro control unit 564 are further controlled by the master control processor 570, so that the signals from the micro control unit 564 are written in the monitor memory display control circuit 580 and the summation memory 576. Thus, the stored data are displayed on the screen of the monitor 590 and/or printed by the printer 578.

Figure 17:
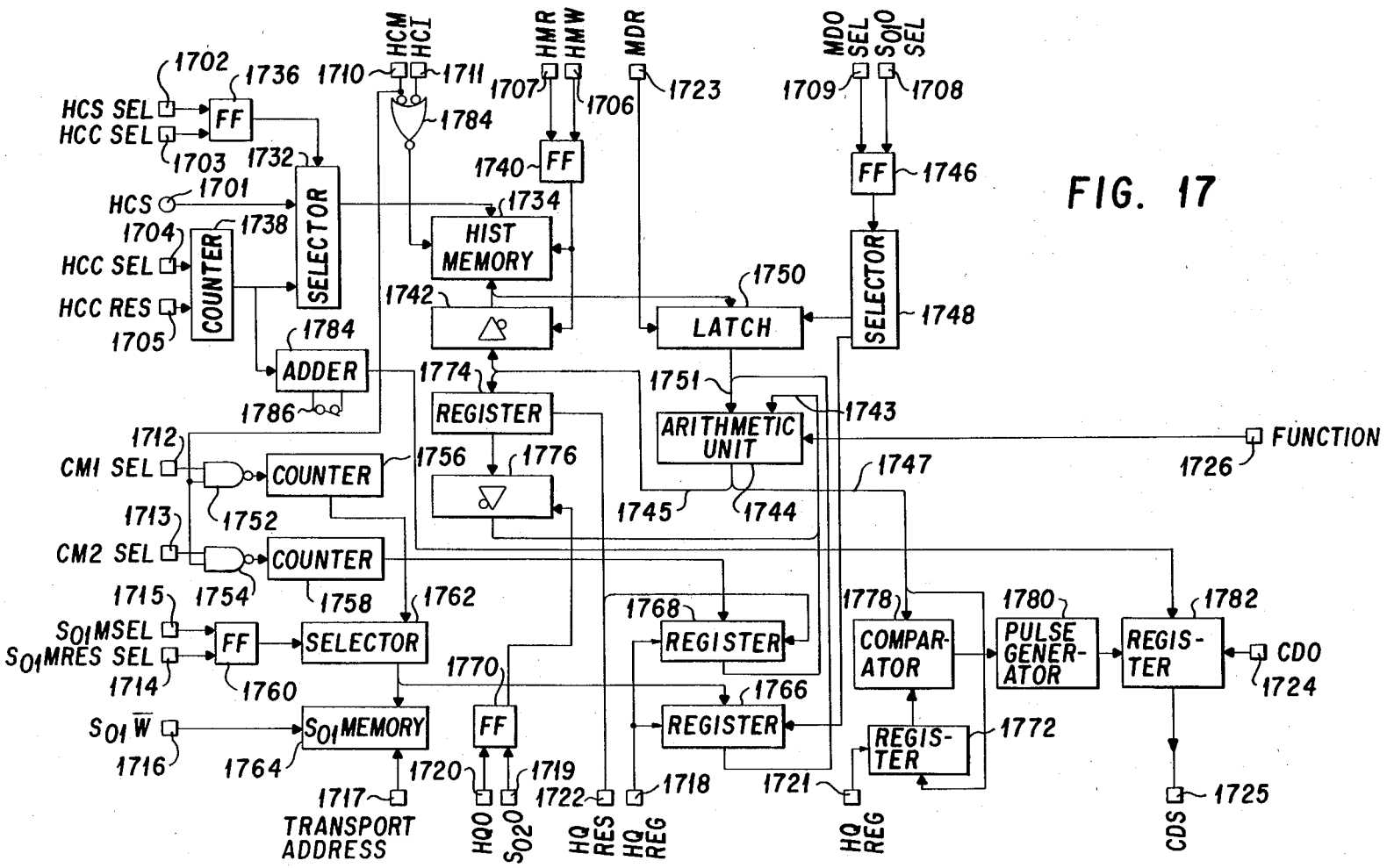
FIG. 17 is a circuit diagram showing a detailed embodiment of the histogram measuring circuit and the color detection circuit.

The circuits 550 and 552 can be arranged as shown in FIG. 17. In FIG. 17, reference numerals 1701 denotes a terminal to which the histogram coefficient signal HCS (0, 1, 2,—, 63) is inputted from the W/G ratio circuit 548. Reference numerals 1702–1726 denotes terminals connected to the bus 563. Reference numerals 1732, 1748, and 1762 denote selectors. Reference numerals 1734 denotes a histogram coefficient memory. Reference numerals 1736, 1740, 1746, 1760 and 1770 denote flip-flops. Reference numerals 1738, 1756 and 1758 denote counters. Reference numeral 1744 denotes an arithmetic unit, for example, composed of four LSIs of S181. Reference numeral 1750 denotes a latch. Reference numerals 1752 and 1754 denote NAND gates. Reference numeral 1764 denotes a memory. Reference numeral 1766, 1768, 1772, 1774 and 1782 denote registers. Reference numerals 1742 and 1776 denote buffer amplifiers. Reference numeral 1778 denotes a comparator. Reference numeral 1780 denotes a pulse generator. Reference numeral 1784 denotes a NOR gate. Reference numeral 1786 denotes a switch.

The operations of the circuit arrangement shown in FIG. 17 will be explained. In the following, histo coefficient is defined as a number indicating one of 0–63 grades W/G. Histo value means the number of picture cells at a corresponding histo coefficient. Histogram represents a curve showing a relationship between histo coefficient and histo value.

(Initialization)

The histo coefficient signal HCS (0–63) is inputted to the terminal 1701 and then is applied as an address signal to the histogram memory 1734 via the selector 1732. The data stored at each address in the histogram memory 1734 represents the number of picture cells Ci of each histo coefficient, i.e., histo value. Before HCS is inputted, every address of the histogram memory 1775 is initialized. This initialization is performed as follows.

(1) The histo coefficient count select HCC SEL is inputted to the flip-flop 1736 which controls the selector 1732, so that the selector 1732 selects HCC.

(2) The histogram memory 1734 is rendered to be in a write condition by the histo memory write signal HMW applied to the terminal 1706 via the flip-flop 1740. In this condition, the buffer amplifier 1742 is made active.

(3) A function signal is applied to the arithmetic unit 1744 via the terminal 1726 to make the output of the arithmetic unit 1744 zero.

The counter 1738 counts from zero to 63 in accordance with HCC SEL signal from the terminal 1704, so that the address corresponding to the count value is accessed in the memory 1734. If the histo count initialization signal HCI is applied to the memory 1734 via the gate 1784 from the terminal 1711 at every time of counting, the data from the buffer amplifier 1742 is written into the memory 1734. Since at this time the output from the arithmetic unit 1744 is zero, the output from the buffer amplifier 1742 is also zero, so that zero is written in every address of the memory 1734. Thereby initialization is completed.

(W/G Data Measurement)

Next, W/G data is written in the memory 1734 as follows For this purpose, the following portions are set.

(1) The histo coefficient signal select HCS SEL is applied to the flip-flop 1736 from the terminal 1702, so that the selector 1732 selects the histo coefficient signal HCS from the terminal 1701.

(2) The memory data output select signal MDO SEL is applied to the flip-flop 1746 from the terminal 1709 to make the latch 1750 active via the selector 1748.

(3) A function signal is applied to the arithmetic unit 1744 to add one to the input signal to the arithmetic unit 1744.

If the HCS signal (0–63) is applied to the selector 1732 in this condition, the data becomes an address signal for the histogram memory 1734. In this condition, the histo memory read signal HMR is applied to the flip-flop 1740 from the terminal 1707 to render the memory 1734 to a read condition, so that the stored histo value Ci is latched to the 1750 in response to the data latch signal MDR from the terminal 1723. After the histo value Ci is latched in the latch 1750, the arithmetic unit 1744 adds 1 to Ci and outputs (Ci+1) to a data line 1745. Subsequently, the histo memory write signal HMW is applied to the histo memory 1734 and the buffer amplifier 1742 via the flip-flop 1740 from the terminal 1706, so that histo memory 1734 is rendered to a write condition and the buffer amplifier 1742 is made active. If the histo count measuring signal HCM is applied to the histo memory 1734 from the terminal 1710, the data (Ci+1) on the data line 1745 is written into the memory 1734 via the buffer amplifier 1742. In this manner, the histo value Ci of each histo coefficient is stored at each address in the histo memory 1734.

(Detection of the Total of Histo Values and the Division of $S_{01}$ and $S_{02}$)

The HCM signal is given at very time that HCS signal is applied, so that the total of histo values, i.e., the total number of the picture elements is detected by counting the HCM signal. In addition, the histo value is divided to the histo values $S_{01}$ and $S_{02}$ taken by the first and second cameras, respectively. The reason will be described later. For this division, the HCM signal is applied to the AND gates 1752 and 1754. The AND gate 1752 and 1754 also receive the first and second camera selection signals CM1 SEL and CM2 SEL from the terminals 1712 and 1713, respectively. As a result, the outputs from the AND gates 1752 and 1754 are applied to the counters 1756 and 1758, respectively, so that the histo values $S_{01}$ and $S_{02}$ by the first and second cameras are stored in the counters 1756 and 1758, respectively.

(Matching of $S_{01}$ and $S_{02}$)

The pictures of the two sides of the orange 204 are taken by the two cameras 206a and 216 which are disposed on the opposite sides of the conveyor belt 301 (FIG. 9-1A) and are offset with respect to each other, so that the data of the front side of the orange and the data of the rear side of the orange are produced at different timings. In order to match these timings, it is required to collect both the data separately and then to delay the data obtained from the first camera which takes the picture of the orange first by a time corresponding to the distance between the two cameras. Thus, the data from the second camera and the delayed data are matched and served for the calculation of the total histo value $S_0=S_{01}+S_{02}$.

For such matching, the $S_{01}$ memory 1764 is first initialized. That is, the $S_{01}$ memory reset select signal $S_{01}$ MRES SEL is applied to the flip-flop 1760 from the terminal 1714, so that the output from the selector 1762 is made zero. This zero data is written in the $S_{01}$ memory 1764 by the $S_{01}$ write signal $S_{01}$W from the terminal 1716.

Since it is necessary that the counter 1756 is cleared immediately after the completion of the measurement of $S_{01}$ in order to be ready to the measurement of a histogram of an orange to be transported subsequently, the measured $S_{01}$ is written into the $S_{01}$ memory 1764. That is, the $S_{01}$ memory select signal $S_{01}$M SEL is applied to the flip-flop 1760 from the terminal 1715, so that the output from the counter 1756 is applied to the $S_{01}$ memory 1764 via the selector 1762 and is written therein by the $S_{01}$ write signal $S_{01}$W from the terminal 1716. A transport address corresponding to the distance between the two cameras is applied to the memory 1764, because of the reason mentioned above.

When the collection of the $S_{02}$ data is completed, the histo value storing signal HQREG is applied to the registers 1766 and 1768 from the terminal 1718, so that the $S_{01}$ data in the memory 1764 is stored in the register 1766 and that the $S_{02}$ data in the counter 1758 is stored in the register 1768.

(Calculation of $\frac{1}{2}$ $S_0$)

In the present invention, the color of an orange is determined as a histogram coefficient N at which the total histo value $S_0=S_{01}+S_{02}$ is divided by two. In order to determine N, $\frac{1}{2}$ $S_0$ is first calculated. Then a histo coefficient is obtained when an integral value of Ci from zero is equal to $\frac{1}{2}$ $S_0$.

In order that $\frac{1}{2}$ $S_0$ is calculated, a function signal at the terminal 1726 is so determined that the arithmetic unit 1744 calculates the sum of the two input signals on the lines 1751 and 1743. The $S_{01}$ output select signal $S_{01}$O SEL is applied to the flip-flop 1746 from the terminal 1708 and then to the selector 1748, so that the data $S_{01}$ stored in the register 1766 is read out and transferred to the arithmetic unit 1744 via the line 1751. The $S_{02}$ outputting signal $S_{02}$O is applied to the flip-flop 1770 from the terminal 1719, so that the data $S_{02}$ stored in the register 1768 is read out and transferred to the arithmetic unit 1744. As a result, the arithmetic unit 1744 produces the sum $S_0=S_{01}+S_{02}$. At this time, the histo value storing signal HQ REG is applied to the register 1772 from the terminal 1721, so that the data $S_0$ is stored in the register 1772 via the line 1747. In the register 1772, bit shift is performed and thus the content in the least significant bit is omitted, so that the stored value becomes a half of the inputted value $S_0$, i.e., $\frac{1}{2}$ $S_0$ is stored in the register 1772.

(Calculation of the Central Value N)

In order to calculate the central value N, the following portions are set.

(1) The HCC SEL signal is applied to the flip-flop 1736 from the terminal 1703, so that the selector 1732 selects the HCC signal from the counter 1738.

(2) The counter 1738 is reset by the histo coefficient count reset signal HCC RES from the terminal 1705.

(3) The register 1774 is reset by the histo value reset signal HQ RES from the terminal 1722.

(4) The histogram memory 1734 is rendered to a read condition by the HMR signal from the terminal 1707.

(5) A function signal at the terminal 1726 is so set that the arithmetic unit 1744 performs the addition of the data in the register 1774 and the latch 1750.

First, the histo value Co is read out from the zero address in the histogram memory 1734, and then is latched in the latch 1750 by the memory data latching signal MDR from the terminal 1723. The memory data output select signal MDO SEL is applied to the flip-flop 1746 from the terminal 1709, so that the data Co stored in the latch 1750 is read out and transferred to the arithmetic unit 1744 through the line 1751. On the other hand, the histo value output signal HQO is applied to the flip-flop 1770 from the terminal 1720, so that the buffer amplifier 1776 is made active. As a result, the data in the register 1774, i.e., zero is applied to the arithmetic unit 1744 via the buffer, amplifier 1776 and through the line 1743. Then, $(Co+0)=Co$ is calculated by the arithmetic unit 1744 and the calculated result is stored in the register 1774.

Next, the HCC SEL signal is applied to the counter 1738 from the terminal 1704 and the histo coefficient i=1 is added to the address in the histogram memory 1734. Then, the memory 1734 outputs the histo value $C_1$, which is latched in the latch 1750. The content in the latch 1750 and the content Co stored in the register 1774 are applied to the arithmetic unit 1744, so that $(Co+C_1)$ is calculated by the arithmetic unit 1744. This calculated result $(Co+C_1)$ is written in the register 1774. The same process is repeated to store the integral value of Ci in the register 1774.

The output from the register 1774 is also applied to the comparator 1778 through the line 1747, so that this output is compared with the $\frac{1}{2}$ So stored in the register 1772. As a result, when both the data becomes equal to each other or the integral value of Ci exceeds $\frac{1}{2}$ So, the comparator 1778 produces an output which triggers the pulse generator 1780 to produce a pulse, which is applied to the register 1782.

On the other hand, the output from the counter 1738 is applied to the adder 1784 to accumulate the value i. The accumulated value is applied to the register 1782. Thus, the central value N is recorded by the pulse from the pulse generator 1780. Further, the switch 1786 serves to determine the central value to be N or (N+1). The colour judgment output CDS is read out from the register 1782 as N or (N+1) an derived from the terminal 1725 in response to the color judgment instruction signal CDO applied to the register 1782 from the terminal 1724.

When the whole surface other than the upper and lower portions of an orange is to be inspected, the orange is rotated. In this case, the processing speed drops. Therefore, in order to compensate for delay in the processing speed, the rotary inspection devices are disposed in parallel as shown in FIG. 16-1. Here, oranges which are supplied to a diameter inspection section 1001 in series are arranged in parallel by a series-to-parallel converter 1002, so that the oranges are fed to a damage and coloring inspection section 1003 where the oranges arranged in parallel are rotated and stopped for camera scanning simultaneously. The oranges are then aligned in one line by a parallel-to-series converter 1004, so that the oranges are fed to a sorting section 1005 in sequence.

Alternatively, as shown in FIG. 16-2, a plurality of rotating tables 1101 may be disposed on a rotary table 1100. The oranges 1102 are supplied to the rotary table 1100 after the measurement of their diameter by a feeding mechanism 1103, so that the oranges are disposed on the rotating tables 1101. The oranges 1102 thus supplied to the rotary table 1100 are carried, while rotating, by rotating the rotary table 1100 to a camera section 1104 for measuring a diameter of the orange 1102 and then to a damage and coloring inspection section 1105. After the section 1105, the orange 1102 is sorted at a sorting section 1106.

While the present invention has been described in conjunction with the sorting of oranges, it is to be understood that the present invention may equally and effectively be used in order to sort other kinds of fruits. However, depending upon the kinds of fruits to be inspected and sorted, the various devices must be suitably modified as will be obvious to those skilled in the art from the above description. For example, the degree of coloring of an apple can be detected by defining W/R and the degree of coloring of a yellow-colored fruit can be detected by defining W/Y (where Y is yellow light). Moreover, the present invention may equally and effectively be applied to the inspection and sorting of other objects or merchandise. The size, coloring, visible damage, marked letters or symbols and so on can be automatically and consequently easily and reliably detected.

As described above, according to the present invention, the outer appearance and grades of objects can rapidly and automatically be detected, so that the sorting of objects can be highly efficiently carried out.

What is claimed is:

1. An outer appearance quality inspection system comprising:

(a) first means for aligning objects to be inspected;

(b) second means for transporting the aligned objects;

(c) third means for illuminating a light within a predetermined wavelength range against the objects being transported.

(d) fourth means for receiving the light reflected from each of said objects so as to convert the light into an electrical signal;

(e) fifth means for detecting macro visible damage of said object in response to the electrical signal derived from said fourth means;

(f) sixth means for detecting micro visible damage of said object in response to the electrical signal derived from said fourth means;

(g) seventh means for producing first data determining a visible damage from the detected micro and macro visible damages;

(h) eighth means for sorting the objects being transported by said second means in response to the first data derived from said seventh means;

ninth means for producing second data representative of the size and coloring of each of said objects, said second data being applied to said eighth means so that said eighth means sorts the objects being transported by said second means in response to the first and second data;

(j) tenth means for forming an average visible light region signal from aid electrical signal;

(k) eleventh means for forming a green region signal from said electrical signal;

(l) twelfth means for obtaining a level ratio of said average visible light region signal to said green region signal;

(m) thirteenth means for obtaining a histogram of said ratio; and (n) fourteenth means for judging coloring of said object from said histogram.

2. An outer appearance quality inspection system as claimed in claim 1, wherein said histogram obtaining means judges that the color of said object is represented by a point in said histogram at which said histogram is equally divided.

3. An outer appearance quality inspection system as claimed in claim 1, further comprising means for displaying said histogram.

4. An outer appearance quality inspection system as claimed in claim 1, wherein said fifth means includes means for smoothening said electrical signal to eliminate a small differential change of said electrical signal and to form an average signal, means for obtaining the local maximum and the local minimum of said electrical signal in a predetermined region, and means for determining an area between the local maximum on both sides of said local minimum as a macro damage area; and said sixth means includes means for obtaining a difference between picture cell information of one picture cell to be emplasized and picture cell information of peripheral picture cells around said one cell as outline information, means for adding said outline information to said picture cell information of said one picture cell to obtain outline-emplasized information with respect to said one picture cell, means for obtaining an average of said picture cell information of said peripheral picture cells, means for obtaining a difference between said average and said picture cell information of said one picture cell, means for determining a micro damage area corresponding to an area where said difference exceeds a predetermined value.

5. An outer appearance quality inspection system as claimed in claim 1, wherein said fourth means has two light receiving portions arranged on both sides of the transporting path defined by said second means.

6. An outer appearance quality inspection system as claimed in claim 1, further comprising means for comparing said first and second data with references for said size, micro and micro visible damage, and coloring of said objects which are variably determined.

7. An outer appearance quality inspection system as claimed in claim 1, further comprising:

means for computing data representative of the distributions of visible damages and coloring of each of said objects; and means for displaying said distributions based upon said first and second data.

8. An outer appearance quality inspection system as claimed in claim 1, further comprising:

means for meauring a horizontal diameter and a vertical diameter of said object;

means for comparing said horizontal diameter with vertical; and means for defining the greater diameter as the maximum diameter of said object.

9. An outer appearance quality inspection system as claimed in claim 1, further comprising means for storing the number of objects which are sorted according to the grades of said objects which are determined by said first and second data.

10. An outer appearance quality inspection system as claimed in claim 1, wherein said first, second, third, fourth, fifth, sixth, seventh, eigth, ninth, tenth, eleventh, twelfth, thirteenth, and fourteenth means are operated in synchronism with each other.

11. An outer appearance quality inspection system comprising:

(a) first means for aligning objects to be inspected;

(b) second means for transporting the aligned objects;

(c) third means for illuminating a light within a predetermined wavelength range against the objects being transported;

(d) fourth means for receiving the light reflected from each of said objects so as to convert the light into an electrical signal;

(e) fifth means for detecting macro visible damage of said object in response to the electrical signal derived from said fourth means;

(f) sixth means for detecting micro visible damage of said object in response to the electrical signal derived from said fourth means;

(g) seventh means for producing first data determining a visible damage from the detected micro and macro visible damages;

(h) eighth means for sorting the objects being transported by said second means in response to the first data derived from said seventh means;

(i) ninth means for producing second data representative of the size and coloring of each of said objects, said second data being applied to said eighth means so that said eighth means sorts the objects being transported by said second means in response to the first and second data;

(j) tenth means for computing data representative of the distributions of visible damages and coloring of each of said objects;

(k) eleventh means for displaying said distributions based upon said first and second data;

(l) twelfth means for forming an average visible light region signal from said electrical signal;

(m) thirteenth means for forming a green region signal from said electrical signal;

(n) fourteenth means for obtaining a level ratio of said average visible light region signal to said green region signal;

(o) fifteenth means for obtaining a histogram of said ratio; and (p) sixteenth means for judging coloring of said object from said histogram.

12. An outer appearance quality inspection system as claimed in claim 11, wherein said average visible light region signal is compared with said green region signal.

13. An outer appearance quality inspection system as claimed in claim 11, wherein said eleventh means displays said distribution in the form of said histogram.

14. An outer appearance quality inspection system as claimed in claim 11, wherein said first, second, third, fourth, fifth, sixth, seventh, eighth, ninth, tenth, eleventh, twelfth, thirteenth, fourteenth, fifteenth, and sixteenth means are operated in synchronism with each other.

15. An outer appearance quality inspection system as claimed in claim 11, further comprising means for comparing said first and second data with references for said size, micro and macro visible damage, and coloring of said objects which are variably determined.

16. An outer appearance quality inspection system as claimed in claim 11, further comprising:

means for measuring a horizontal diameter and a vertical diameter of said object;

means for comparing said horizontal diameter with said vertical diameter; and means for defining the greater diameter as the maximum daiemter of said object.

17. An outer appearance quality inspection system as claimed in claim 11, further comprising means for storing the number of objects which are sorted according to the grades of said objects which are determine by said first and second data.

18. An outer appearance quality inspection system as claimed in claim 11, wherein said fifth means includes means for smoothening said electrical signal to eliminate a small differential change of said electrical signal and to form an average signal, means for obtaining the local maximum and the local minimum of said electrical signal in a predetermined region, and means for determining an area between the local maximum on both sides of said local minimum as a macro damage area; and said sixth means includes means for obtaining a difference between picture cell information of one picture cell to be emphasized and picture cell information of peripheral picture cells around said one cell as outline information, means for adding said outline information to said picture cell information of said one picture cell to obtain outline-emphasized information with respect to said one picture cell, means for obtaining an average of said picture cell information of said peripheral picture cells, means for obtaining a difference between said average and said picture cell information of said one picture cell, means for determining a micro damage area corresponding to an area where said difference exceeds a predetermined value.

19. An outer appearance quality inspection system as claimed in claim 11, wherein said fourth means has two light receiving portions arranged on both sides of the transporting path defined by said second means.

20. An outer appearance quality inspection system comprising:

(a) first means for aligning objects to be inspected;

(b) second means for transporting the aligned objects;

(c) third means for illuminating a light within a predetermined wavelength range against the objects being transported;

(d) fourth means for receiving the light reflected from each of said objects so as to convert the light into an electrical signal;

(e) fifth means for obtaining the data representative of the conditions of the surfaces of said object in response to the electrical signal derived from said fourth means, said fifth means producing data representative of the size, visible damage and coloring of each of said objects so as to sort said objects, means for forming an average visible light region signal from said electrical signal, means for forming a green region signal from said electrical signal, means for obtaining a level ratio of said average visible light region signal to said green region signal, means for obtaining a histogram of said ratio, and means for judging coloring of said object from said histogram; and (f) sixth means for sorting the objects being transported by said second means in response to the data derived from said fifth means.

21. An outer appearance quality inspection system as claimed in claim 20, wherein said histogram obtaining means judges that the color of said object is represented by a point in said histogram at which said histogram is equally divided.

22. An outer appearance quality inspection system as claimed in claim 20, wherein said fifth means further includes:

means for measuring a horizontal diameter and a vertical diameter of said object;

means for comparing said horizontal diameter with said vertical diameter; and means for defining the greater diameter as the maximum diameter of said object.

23. An outer appearance quality inspection system as claimed in claim 20, further comprising means for storing the number of objects which are sorted according to the grades of said objects which area determined by data derived from said fifth means.

24. An outer appearance quality inspection system as claimed in claim 20, wherein said first, second, third, fourth, fifth, and sixth means are operated in synchronism with each other.

25. An outer appearance quality inspection system as claimed in claim 20, wherein said fifth means further includes:

means for smoothening said electrical signal to eliminate a small differential change of said electrical signal and to form an average signal, means for obtaining the local maximum and the local minimum of said electrical signal in a predetermined region, and means for determining an area between the local maximum on both sides of said local minimum as a macro damage area; and means for obtaining a difference between picture cell information of one picture cell to be emphasized and picture cell information of peripheral picture cells around said one cell as outline information, means for adding said outline information to said picture cell information of said one picture cell to obtain outline-emphasized information with respect to said one picture cell, means for obtaining an average of said picture cell information of said peripheral picture cells, means for obtaining a difference between said average and said picture cell information of said one picture cell, means for determining a micro damage area corresponding to an area where said difference exceeds a predetermined value.

26. An outer appearance quality inspection system as claimed in claim 20, wherein said fourth means has two light receiving portions arranged on both sides of the transporting path defined by said second means.

27. An outer appearance quality inspection system comprising:

(a) first means for aligning objects to be inspected;

(b) second means for transporting the aligned objects;

(c) third means for illuminating a light within a predetermined wavelength range against the objects being transported;

(d) fourth means for receiving the light reflected from each of said objects so as to convert the light into an electrical signal;

(e) fifth means for obtaining the data representative of the conditions of the surfaces of said object in response to the electrical signal derived from said fourth means, said fifth means producing data representative of the size, visible damage and coloring of each of said objects so as to sort said objects, said fifth means having means for computing data representative of the distributions of visible damages and coloring of each of said objects, said system further comprising seventh means for displaying said distributions based upon said data derived from said fifth means, means for forming an average visible light region signal from said electrical signal, means for forming a green region signal from said electrical signal, means for obtaining a level ratio of said average visible light region signal to said green region signal, means for obtaining a histogram of said ratio, and means for judging coloring of said object from said histogram; and (f) sixth means for sorting the objects being transported by said second means in response to the data derived from said fifth means.

28. An outer appearance quality inspection system as claimed in claim 27, wherein said fifth means further includes:

means for measuring a horizontal diameter and a vertical diameter of said object;

means for comparing said horizontal diameter with said vertical diameter; and means for defining the greater diameter as the maximum diameter of said object.

29. An outer appearance quality inspection system as claimed in claim 27, further comprising means for storing the number of objects which are sorted according to the grades of said objects which are determined by data derived from said fifth means.

30. An outer appearance quality inspection system as claimed in claim 27, wherein said first, second, third, fourth, fifth, and sixth means are operated in synchronism with each other.

31. An outer appearance quality inspection system as claimed in claim 27, wherein said fifth means further includes:

means for smoothening said electrical signal to eliminate a small differential change of said electrical signal and to form an average signal, means for obtainin the local maximum and the local minimum of said electrical signal in a predetermined region, and means for determining an area between the local maximum on both sizes of said local minimum as a macro damage area; and means for obtaining a difference between picture cell information of one picture cell to be emphasized and picture cell information of peripheral picture cells around said one cell as outline information, means for adding said outline information to said picture cell information of said one picture cell to obtain outline-emphasized information with respect to said one picture cell, means for obtaining an average of said picture cell information of said peripheral picture cells, means for obtaining a difference between said average and said picture cell information of said one picture cell, means for determining a micro damage area corresponding to an area where said difference exceeds a predetermined value.

32. An outer appearance quality inspection system as claimed in claim 27, wherein said fourth means has two light receiving portions arranged on both sides of the transporting path defined by said second means.

33. A color analysis system comprising:

means for illuminating a light within a predetermined wavelength range against an object;

means for receiving the light reflected from said object so as to convert the light into an electrical signal;

means for producing data representative of coloring of said object;

means for forming an average visible light region signal from said electrical signal;

means for forming a green region signal from said electrical signal;

means for obtaining a level ratio of said average visible light region signal to said green region signal;

means for obtaining a histogram of said ratio; and means for judging coloring of said object from said histogram.

34. A color analysis system as claimed in claim 33, wherein said histogram obtaining means judges that the color of said object is represented by a point in said histogram at which said histogram is equally divided.

35. A color analysis system as claimed in claim 33, further comprising means for displaying said distribution in the form of said histogram.

36. A color analysis system comprising:

means for illuminating a light within a predetermined wavelength range against an object;

means for receiving the light reflected from said object so as to convert the light into an electrical signal;

means for computing data representative of the distributions of coloring of said object;

means for displaying said distributions based upon said data;

means for forming an average visible light region signal from said electrical signal;

means for forming a green region signal from said electrical signal;

means for obtaining a level ratio of said average visible light region signal to said green region signal;

means for obtaining a histogram of said ratio; and means for judging coloring of said object from said histogram.

37. A color analysis system as claimed in claim 36, wherein said average visible light region signal is compared with said green region signal.

38. A color analysis system as claimed in claim 36, wherein said display means displays said distribution in the form of said histogram.

* * * * *

UNITED STATES PATENT AND TRADEMARK OFFICE

CERTIFICATE OF CORRECTION

PATENT NO. : 4,735,323

DATED : Apr. 5, 1988

INVENTOR(S) : OKADA, et al

It is certified that error appears in the above-identified patent and that said Letters Patent is hereby corrected as shown below:

Col. 5, line 64, change "cros" to --cross--.

Cols. 9, 10, Table 1-2, insert heading --Sorting Performance-- beneath "Nozzle No." and above "Grade Classification".

Cols. 9, 10, Table 1-3, beneath "Totalization", after "1-10", change "grdes" to --grades--.

Cols. 11, 12, Table 1-4, for "Display-coloring", under heading "Camera 216", the phrase "accumulated display by camera" should be inserted.

Col. 22, line 21, change "v" to --y--.

Col. 28, line 4, before "ninth" insert --(i)--.

Col. 28, line 11, change "aid" to --said--.

Col. 28, line 42, change "emplasized" to --emphasized--.

Col. 28, line 46, change "emplasized" to --emphasized--.

Col. 28, line 62, change "micro", second occurrence, to --macro--.

Col. 29, line 18, change "eigth" to --eighth--.

UNITED STATES PATENT AND TRADEMARK OFFICE

CERTIFICATE OF CORRECTION

PATENT NO. : 4,735,323

DATED : Apr. 5, 1988

INVENTOR(S) : OKADA, et al

It is certified that error appears in the above-identified patent and that said Letters Patent is hereby corrected as shown below:

Col. 30, line 22, change "daiemter" to --diameter--.

Col. 31, line 35, change "area" to --are--.

Col. 32, line 59, change "obtainin" to --obtaining--.

Signed and Sealed this

Nineteenth Day of September, 1989

*Attest:*

DONALD J. QUIGG

*Attesting Officer*

*Commissioner of Patents and Trademarks*